US007926934B2

(12) United States Patent
Tanabe

(10) Patent No.: US 7,926,934 B2
(45) Date of Patent: Apr. 19, 2011

(54) RECORDING SHEET CONTAINING CASSETTE AND PRINTER APPARATUS USING THE SAME CASSETTE

(75) Inventor: Minoru Tanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1115 days.

(21) Appl. No.: 11/668,748

(22) Filed: Jan. 30, 2007

(65) Prior Publication Data

US 2007/0195147 A1 Aug. 23, 2007

(30) Foreign Application Priority Data

Feb. 20, 2006 (JP) ..... 2006-042535

(51) Int. Cl.
*B41J 2/01* (2006.01)

(52) U.S. Cl. ..... 347/104; 347/101

(58) Field of Classification Search ..... 347/104, 347/101, 108; 271/145–171; 400/208, 624
See application file for complete search history.

(56) References Cited

U.S. PATENT DOCUMENTS

| | | | | |
|---|---|---|---|---|
| 5,238,235 | A * | 8/1993 | Nitta et al. | 347/108 |
| 5,480,247 | A | 1/1996 | Saikawa et al. | 400/629 |
| 6,069,642 | A | 5/2000 | Isobe | 347/176 |
| 6,082,913 | A * | 7/2000 | Yamamoto et al. | 400/208 |
| 2007/0122221 | A1 * | 5/2007 | Kitamura et al. | 400/120.01 |
| 2007/0195146 | A1 | 8/2007 | Tanabe | 347/104 |

FOREIGN PATENT DOCUMENTS

| | | |
|---|---|---|
| EP | 0792752 | 9/1997 |
| JP | 02 081660 | 3/1990 |
| JP | 2523355 | 5/1996 |
| JP | 8-319036 | 12/1996 |
| JP | 2000-108442 | 4/2000 |

OTHER PUBLICATIONS

European Search Report dated Dec. 5, 2007 in European Application No. EP 07 10 1984.8.
European Search Report dated Sep. 14, 2007 in European Application No. EP 07 10 1984.8.

* cited by examiner

*Primary Examiner* — Manish S Shah
(74) *Attorney, Agent, or Firm* — Fitzpatrick, Cella, Harper & Scinto

(57) ABSTRACT

A recording sheet/ink sheet integral type cartridge, includes a recording sheet containing portion that contains recording sheets by stacking the sheets; and an ink sheet containing portion that contains ink sheets, the recording sheet containing portion including two separating pawls disposed to catch corners of a leading edge of the recording sheet in a feeding direction and separating the recording sheet and a first aperture portion formed in one of two side surfaces of said recording sheet containing portion in a direction orthogonal to the recording sheet feeding direction, and urging the recording sheet, wherein one of the two separating pawls, which is closer to the first aperture portion, is larger than the other.

6 Claims, 30 Drawing Sheets

RECORDING SHEET CONTAINING CASSETTE AND PRINTER APPARATUS USING THE SAME CASSETTE

BACKGROUND OF THE INVENTION

1. Field of the Invention

The present invention relates to a printer apparatus that prints an image on a recorded material such as a recording sheet based on image information and to a cassette or a cartridge as consumables thereof.

2. Description of the Related Art

A printer apparatus as an output apparatus for a computer and a digital video output apparatus can be classified corresponding to recording systems into a thermal transfer printer apparatus, an ink jet printer apparatus, a laser printer apparatus and a wire dot printer apparatus. Among these printer apparatuses, the line thermal transfer printer apparatus employs ink sheets and recording sheets, selectively drives a plurality of heating elements arrayed in a main scan direction and thus conveys the ink sheet and the recording sheet in a sub-scan direction, thereby printing an image in dot lines on the recording sheet. Over the recent years, with advancements of input devices handling the images such as a digital camera, a digital video camera and a scanner as input side devices, the thermal transfer printer apparatus is increasingly focused. The thermal transfer printer apparatus is suited to printing and outputting, via a computer or a recording medium, electronic image information captured by a still camera recording a statistic image and a video camera.

Other types of printer apparatuses such as the ink jet printer apparatus have no alternative but to select binary values showing whether a dot is formed or not, and therefore obtain an apparent resolution and an apparent gradation by a method such as an error diffusion method while forming minute dots on the recording sheet. By contrast, the thermal transfer printer apparatus can easily change a heat value enabling one pixel to be controlled and is therefore capable of taking more of gradations about one pixel. Accordingly, the thermal transfer printer apparatus has an advantage of its being capable of acquiring smoother and higher-quality images than by other types of printer apparatuses such as the ink jet printer apparatus. The thermal transfer printer apparatus has improved performance of a thermal head serving as a recording unit and also improved performance of a material of a recoding sheet, and can therefore acquire an image print that is not inferior to a silver halide photo (print) in terms of a finishing quality level. As a result, the thermal transfer printer apparatus has been focused especially as a printer for natural images so as to match its stride to the advancements of the digital cameras over the recent years.

There is an advent of a system that performs direct printing and direct outputting without connecting the thermal transfer printer apparatus to the imaging devices such as the digital camera and the video camera. Another system is that the thermal transfer printer apparatus and the imaging device are integrally constructed, and the captured image information is directly printed and output with no intermediary of an image information processing device such as a computer. This type of system enables an easy photographic printout of the image information given from the digital camera and the digital video camera, and a much higher focus is placed on the thermal transfer printer apparatus. The thermal transfer type, however, needs to repeatedly transfer inks in plural colors in superposition in order to conduct full-color printing. A general construction for actualizing this full-color printing will hereinafter be described.

FIGS. 33A and 33B illustrate a first example of the general construction of the conventional thermal transfer printer. As illustrated in FIG. 33A, only an uppermost recording sheet P among the recording sheets P stacked in a recording sheet cassette 107 is separated and fed by a sheet feeding roller 108 and a separating member 109 and is conveyed to between a thermal head 104 and a platen roller 105. Ink sheet 106 is disposed between the thermal head 104 and the recording sheet P. The recording sheet P is wound along the periphery of the platen roller 105 having a slightly longer outer periphery than an entire length of the recording sheet P. The ink sheet 106 and the recording sheet P are brought into a press-contact with each other by the thermal head 104 and the platen roller 105. An ink on the ink sheet 106 is thermally transferred onto the recording sheet P by the heat emitted from the thermal head 104, and meanwhile the platen roller 105 is rotated, thereby performing the printing operation. For performing the next-color printing after finishing the first-color printing, as illustrated in FIG. 33B, the contact-pressure by the thermal head 104 is canceled. The recording sheet P is moved forward up to a print start position by further rotating the platen roller 105. The second and subsequent color printing is done by the same operation as of the first floor. Thus, the full-color printing is conducted in a way that superposes the three colors, yellow, magenta and cyan.

FIGS. 34A and 34B illustrate a second example of the general construction of the conventional thermal transfer printer. As illustrated in FIG. 34A, only the uppermost recording sheet P among the recording sheets P stacked in the sheet cassette 201 is separated and fed by the sheet feeding roller 202 and the separating member 203 and conveyed to a thermal head 204 and a platen roller 205. The ink sheet 206 and the recording sheet P are brought into the press-contact with each other by the thermal head 204 and the platen roller 205. An ink on the ink sheet 206 is thermally transferred onto the recording sheet P by the heat emitted from the thermal head 204, and meanwhile the recording sheet P is conveyed by a pair of rollers, i.e., a capstan roller 207 and a pinch roller 208, provided downstream in the printing direction, thus conducting the printing. Upon an end of the first color print, as illustrated in FIG. 34B, the press-contact by the thermal head unit 204 is canceled for performing the next-color printing. The recording sheet P is moved back to the print start position by rotating the capstan roller 207 and the pinch roller 208 in the directions opposite to those when performing the printing operation. Then, the recording sheet P undergoes the second and subsequent color printing by the same operation as of the first color. Thus, the full-color printing is performed in a way that superposes the three colors, yellow, magenta and cyan.

Also in the examples in FIGS. 33A, 33B, 34A and 34B, the recording sheets and the ink sheets within the sheet cassette are consumables, and need exchanging and replenishing according to how much the sheets are consumed. Herein, as to the ink sheets, it is a general practice, a user is supplied with a cartridge taking such a mode that both edges of the ink sheets are wound on two bobbins, and the two bobbins and the ink sheets are contained in a frame body. FIGS. 33A, 33B, 34A and 34B illustrate frame bodies 110 and 210 of the cartridge. The cartridge has air gap areas 110*a* and 210*a* as illustrated in FIGS. 33A, 33B, 34A and 34B. When loading the cartridge into the printer, the cartridge is guided and installed in a predetermined position so that the thermal heads 104, 204 provided in the printer body are fitted in the air gap areas 110*a*, 210*a*.

The two types described above have been those conventional. The first example has demerits. One demerit is that the apparatus is to be upsized because of requiring the platen roller having a slightly longer outer periphery than an entire length of the recording sheet P. Another demerit is that the apparatus gets complicated because of requiring, though not illustrated in FIGS. 33A and 33B, a mechanism for winding the recording sheet along the periphery of the platen roller and thus holding the sheet-wound roller. The first example has, however, a merit enabling a speedup of print time due to no necessity of a period of time for returning the recording sheet as done in the second example because of the second-color print starting portion existing just posterior to the first-color printing portion upon terminating the first color printing. On the other hand, the second example has, though there is such a demerit that the printing time extends, a merit that facilitates downsizing and simplifying the apparatus.

The thermal transfer printer apparatus described above, however, involves using, as the recording sheet, a dedicated sheet having a surface that is easy to transfer the ink in order to acquire a preferable print. Therefore, a set of the ink cartridge containing the ink sheets for, e.g., fifty recording sheets and these recording sheets, is commercially available. As a result, the user takes a trouble to open a package of the recording sheets and the ink cartridge that are put on the market as a sheet-cartridge set and to employ the printer apparatus by loading the ink cartridge into a printer body and the recording sheets into the sheet cassette, respectively.

The thermal transfer printer, as illustrated in FIGS. 35A and 35B can lessen futility of the ink sheets by preparing different sizes of ink sheets corresponding to predetermined sizes of recording sheets. Accordingly, the commercially available sheet-cartridge sets are, e.g., a set of the A6-size recording sheets and the ink cartridge containing the ink sheets for the A6 size and a set of the A7-size recording sheets and the ink cartridge containing the ink sheets for the A7 size. The user purchases the sheet-cartridge set corresponding to each application. When performing the A7-size printing after the A6-size printing, the user takes out the A6-size recording sheets and the ink cartridge for the A6 size and loads, in place of this sheet-cartridge set, the A7-size recording sheets and the ink cartridge for the A7 size. Hereat, the taken-out A6-size recording sheets and ink cartridge for the A6 size need keeping for a later use. A trouble in this case is that the ink cartridge and the recording sheets are prepared separately and must be protected from being exposed to dusts and direct sunlight and be kept in storage bags.

Japanese Patent No. 2523355 and Japanese Patent Application Laid-Open No. 2000-108442 discuss cartridges (one of which is called a cassette in Japanese Patent Application Laid-Open No. 2000-108442) containing the ink sheets and the recoding sheets as an integral type by way of proposals for solving those troubles.

However, a construction of the thermal transfer printer discussed in Japanese Patent No. 2523355 is that the printing operation, though an ink sheet containing portion and a recording sheet containing portion are formed integrally, can not be conducted in a state where the ink sheets remain contained in the cartridge. Therefore, for conducting the printing operation, this thermal transfer printer requires a mechanism for taking the ink sheet out of the cartridge and loading the ink sheet up to a print position. Such a problem arises that the apparatus gets complicated to a degree corresponding to this mechanism and the reliability declines. A printer solving this problem is a thermal transfer printer discussed in Japanese Patent Application Laid-Open No. 2000-108442. A proposal thereof is that there is no necessity of loading the ink sheet up to the print position after housing the integral type cartridge into the printer body, and the printing operation can be conducted in an as-housed state. The construction makes the user be aware of neither the trouble of setting the ink sheets and the recording sheets separately in the printer apparatus nor the trouble of separately keeping the ink sheets and the recording sheets taken out on the occasion of using a different type of recording sheets. In the case of placing a first purpose on printing a photo, however, the sheets to be used require a predetermined thickness for ensuring a keeping quality, durability or a print quality. Hence, if extremely bent when conveyed for printing, the printing surface might be damaged or corrugated. If large of the thickness of the recording sheet and if there is no space area in which the recording sheet is given a sufficient flexure when separating the recording sheet, the reliability declines depending on a separation method of separating the single recording sheet from the cartridge. The cartridge discussed in Japanese Patent Application Laid-Open No. 2000-108442 has a contrivance of forming an external shape of the cartridge with "R" of a slightly large radius so as not to cause, though a sheet conveyance route is formed by an external peripheral surface of the cartridge, the extreme bending in order to restrain the sheet from being damaged and to increase the reliability on the conveyance. The inside of a circular arc for forming the conveyance route, however, turns out to be a futile space. A thicknesswise space of the cartridge is needed to a certain or larger degree in order to smoothen the bending of the conveyance route, and the downsizing reaches its limit. After all, the cartridge comes to have a size larger than required at the minimum for containing the recording sheets and the ink sheets, resulting in an upsized printer body.

It is to be noted that Japanese Patent Application Laid-Open No. H08-319036 discusses a construction scheming to raise the separation reliability of a pawl separating system and to keep constant a distance between a separating pawl and a pick-up roller even in the case of a different size of sheet. According to this system, an amount of engagement between the separating pawl and the sheet is invariably fixed, and the separation reliability can be ensured. This system is complicated in mechanism and leads to the upsized apparatus, resulting in a cost-up.

SUMMARY OF THE INVENTION

It is an object of the present invention, which was devised in view of the problems described above, to provide an apparatus exhibiting high separation reliability of a recording sheet in a cassette including separating pawls.

It is another object of the present invention to solve a problem that the reliability of separation by the pawls declines and corrugations occur when separated due to a difference between widthwise lengths of contact areas of two separating pawls with the recording sheet at both of side edges of the sheet as affected by a tolerance of a sheet size in the case of feeding the sheet by a pawl separation system.

To accomplish the above objects, a cassette according to the present invention includes a recording sheet containing portion that contains recording sheets, first and second separating pawls, disposed to engage with both of corners of a leading edge, in a sheet feeding direction, of the recording sheet in the recording sheet containing portion, and separating the recording sheet, a regulating member that regulates a position of one edge of the recording sheet contained in the recording sheet containing portion, and an urging member that urges the recording sheet to abut on the regulating member, wherein the first separating pawl of the first and second separating pawls, which is closer to the regulating member, is formed smaller than the second separating pawl.

According to the present invention, in the case of feeding the sheet by the pawl separating system, the separation reliability can be improved by minimizing the difference between the widthwise lengths of the contact areas of the separating pawls with the recording sheet even when a manufacturing error of the recording sheet occurs.

Further features of the present invention will become apparent from the following description of an exemplary embodiment with reference to the attached drawings.

DESCRIPTION OF THE EMBODIMENTS

An embodiment of the present invention will hereinafter be described with reference to the drawings.

A construction of an embodiment of a recording sheet/ink sheet integral type cartridge according to the present invention will be described with reference to FIGS. 1 and 2. Note that the recording sheet/ink sheet integral type cartridge represents a cartridge detachably attachable to a printer body, the cartridge being constructed to make integral a recording sheet containing portion for containing the recording sheets with an ink sheet containing portion for containing ink sheets.

Figure 1:
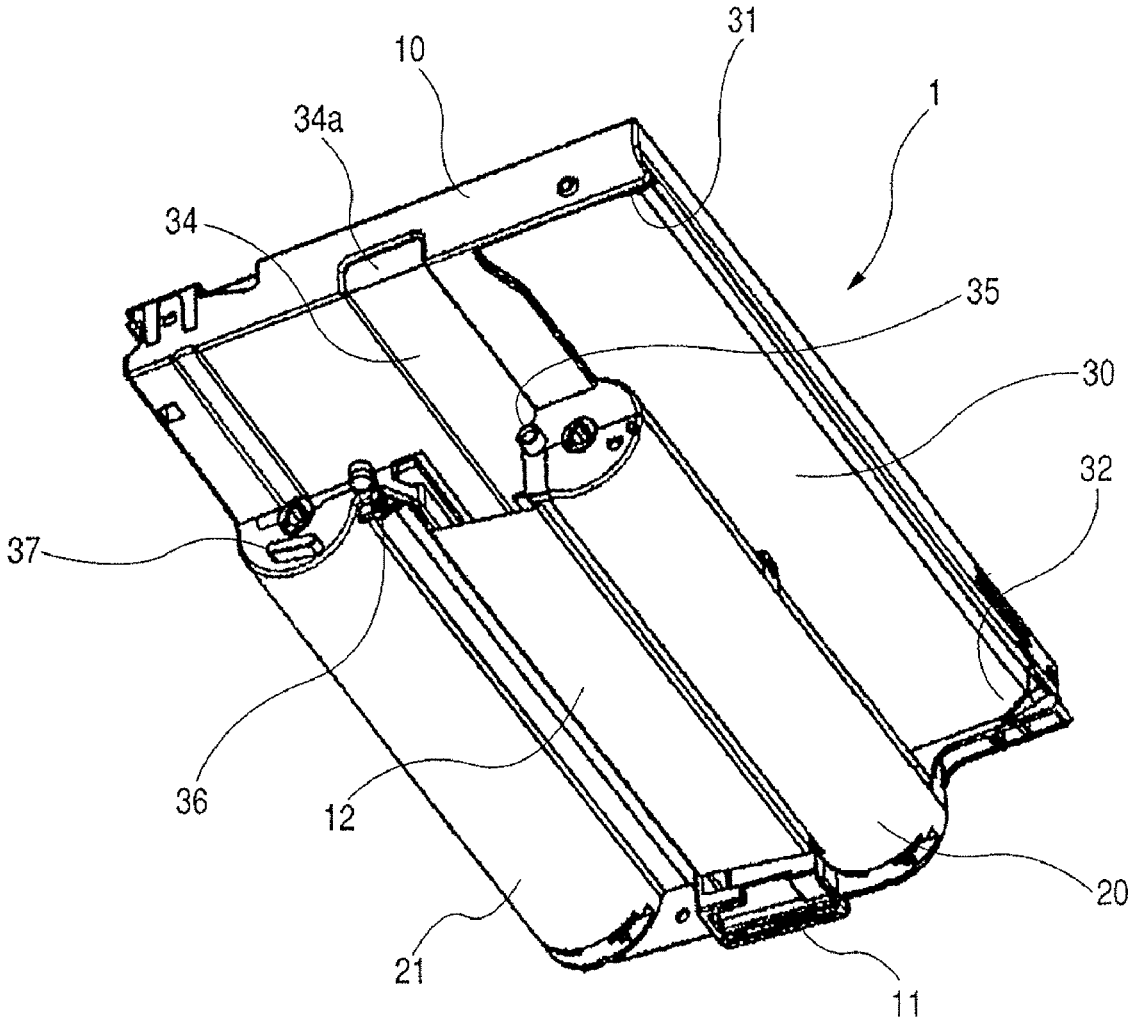
FIG. 1 is an explanatory view of a recording sheet/ink sheet integral type cartridge according to an embodiment of the present invention.

A recording sheet/ink sheet integral type cartridge 1 in the present embodiment illustrated in FIG. 1 includes mainly an upper case 10 that constructs a recording sheet containing portion mainly for stacking and thus containing the recording sheets. The cartridge 1 further includes a lower case 11 that constructs an ink sheet containing portion between the upper case 10 and the lower case 11 itself. The ink sheet containing portion constructs a supply-side containing portion 20 (a first containing portion) that contains pre-printing ink sheets. The ink sheet containing portion further constructs a wind-up side containing portion 21 (a second containing portion) that contains the post-printing ink sheets.

A bottom surface of the cartridge 1 is formed with a feeding port 30 via which to take out the recoding sheets on a sheet-by-sheet basis from the cartridge. The feeding port 30 has an aperture neighboring to the supply-side containing portion 20. This aperture taking substantially a rectangular shape is formed extending over an entire area in a longitudinal direction of the recording sheet at an edge portion of the recording sheet containing portion. Separating pawls 31, 32 for separating the recording sheets on the sheet-by-sheet basis are provided at both edge portions of the feeding port 30. The upper case 10 and the lower case 11 are formed by injection molding of plastic, thereby scheming for cost-down.

Figure 2:
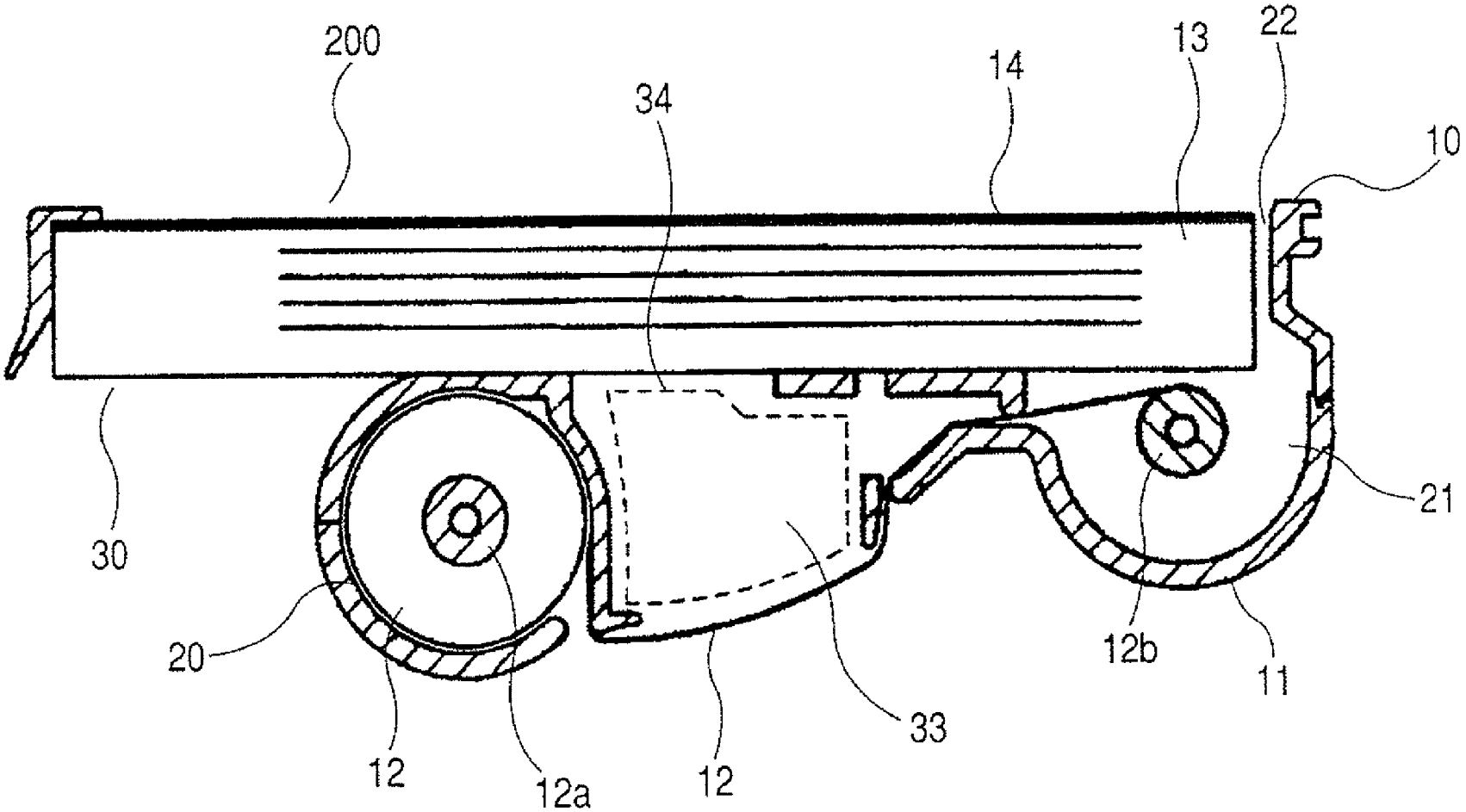
FIG. 2 is a sectional view of a recording sheet/ink sheet integral type cartridge according to an embodiment of the present invention.

FIG. 2 is a sectional view as viewed in a direction orthogonal to an axis-direction of an ink sheet wind-up shaft.

FIG. 2 illustrates how a belt-shaped ink sheet 12 is contained in the ink sheet containing portion formed between the upper case 10 and the lower case 11. A first bobbin 12*a* is disposed in the supply-side containing portion 20 of the ink sheet containing portion. A second bobbin 12*b* is housed in the wind-up side containing portion 21. The ink sheet 12 is wound on the first bobbin 12*a* while a tip of the sheet is secured by bonding to the second bobbin 12*b* for winding up the sheet.

The same number of recording sheets 13 as a printable number of ink sheets 12 are stacked and thus contained in the recording sheet containing portion 22 of the upper case 10. For example, if the ink sheets 12 for 50 pictures are wound up, the fifty recording sheets 13 are also contained. Namely, in the recording sheet/ink sheet integral type cartridge in the present proposal, when the prints for, e.g., the 50 pictures are finished, both of the recording sheets and the ink sheets are consumed up simultaneously. It never happens in the present cartridge that only the recording sheets or the ink sheets are consumed up earlier. Therefore, a user may simply exchange the cartridge each time the recording sheets and the ink sheets are consumed up in a way that neither replenishes nor exchanges only one type of sheets. This contrivance leads to a saving of labor for the exchange.

The cartridge 1 has an upper surface aperture 200 via which the recording sheets 13 and a protection sheet 14 are set into the upper case 10. The upper surface aperture 200 is an aperture from which to pressurize the sheets when loading the cartridge 1 into the printer and performing the printing operation.

The protection sheet 14 prevents the recording sheets 13 from being contaminated and damaged. The protection sheet 14 takes an external shape that is substantially the same in external dimensions as those of the recording sheet 13. The protection sheet 14 is contained in the recording sheet containing portion 22 in a state of being superposed on an uppermost surface of the recording sheets 13. As illustrated in FIG. 2, a space area 33 is formed between the ink sheet supply-side containing portion 20 and the wind-up side containing portion 21 and between the ink sheet 12 and the recording sheet 13. The space area 33 is a space area where a head unit, which will be described later on, is situated when the present cartridge is loaded into the printer. An aperture 34 (a second aperture portion) is formed in a middle area between the supply-side containing portion 20 and the wind-up side containing portion 21 of the upper case 10. The aperture 34 extends over almost all the area in the longitudinal direction of the recording containing portion 22. As illustrated in FIG. 1, the aperture 34 communicates with a side surface aperture 34*a* (a first aperture portion) formed in one of two side surfaces of the upper case 10. The side surface aperture 34*a* is provided on a leading side when loading the cartridge 1 into the printer.

As illustrated in FIG. 1, a first positioning hole 35 is formed in an edge surface of the supply-side containing portion 20 for the ink sheets. Similarly, a second positioning hole 36 is formed in the vicinity of an edge surface of the wind-up side containing portion 21. These positioning holes 35, 36 are fitted on positioning shafts of the printer body when the cartridge 1 is loaded into the printer. The positioning holes 35, 36 serve to stabilize running and winding up the ink sheet by regulating the position in the vicinity of the wind-up shaft of the ink sheet.

A cartridge distinguishing protrusion 37 taking a different shape depending on the type of the cartridge is formed in the vicinity of the edge surface of the wind-up side containing portion 21. The cartridge distinguishing protrusion 37 differentiates the protruded shape corresponding to a difference in size between the recording sheets or in type between the ink sheets. The printer body distinguishes between the sizes or the types, whereby the conveyance and the printing of the recording sheet are controlled corresponding to the size of the recording sheet or the type of the ink sheet.

Figures 16A, 16B, 16C:
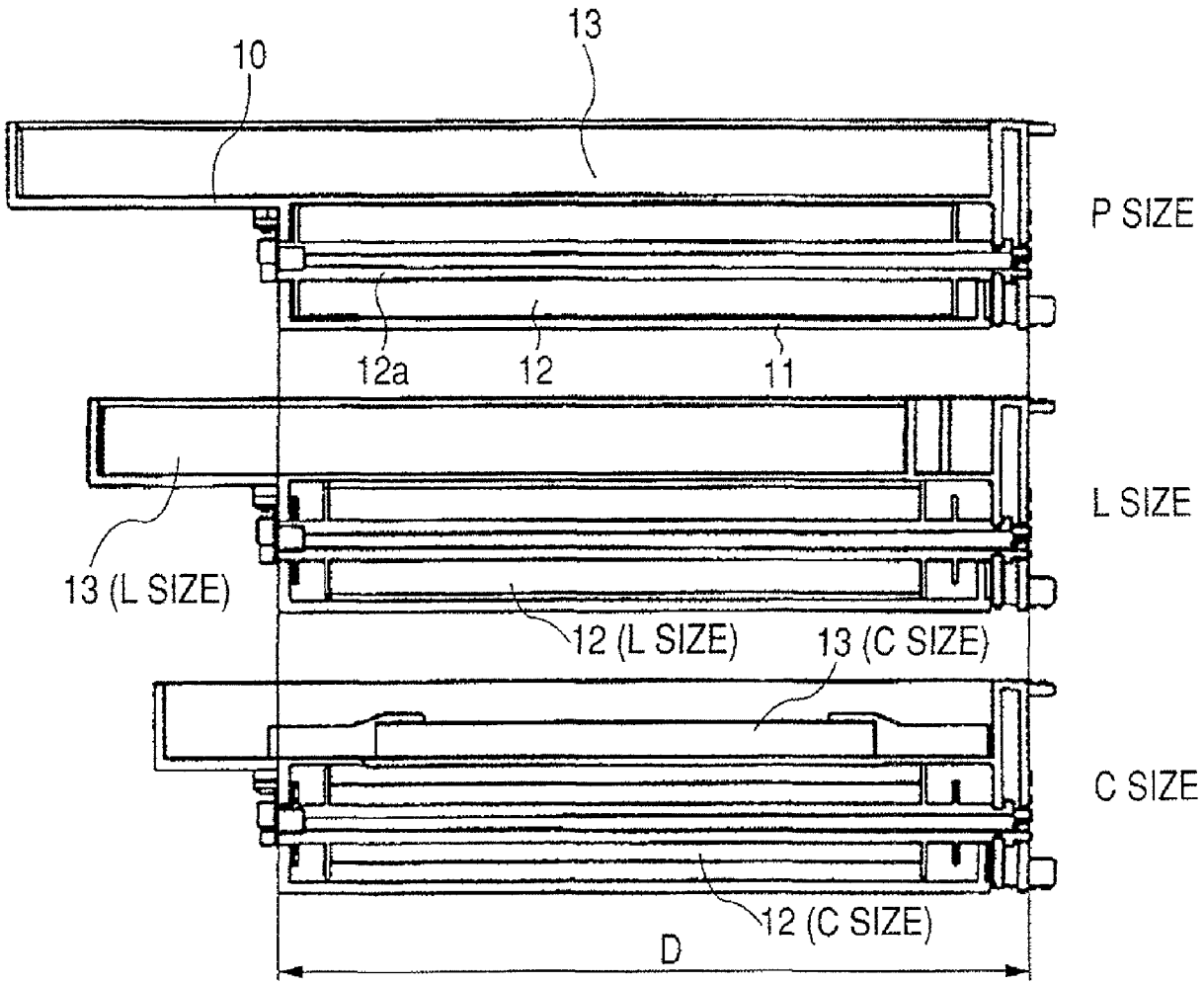
FIGS. 16A, 16B and 16C are views illustrating the three types of recording sheet/ink sheet integral type cartridges corresponding to the different sizes of recording sheets according to the embodiment of the present invention.

The types of the cartridges will be described with reference to FIGS. 15A, 15B, 15C, 16A, 16B and 16C. FIGS. 15A, 15B, 15C, 16A, 16B and 16C illustrate three types of cartridges for different sizes of recording sheets. FIGS. 15A, 16A, FIGS. 15B, 16B and FIGS. 15C, 16C illustrate a post-size (Psize) cartridge, an L-size (Lsize) cartridge and a card-size (Csize) in this sequence. FIGS. 16A, 16B and 16C are sectional views of the supply-side containing portion 20 as viewed from the feeding port 30 in FIG. 1. As illustrated in FIGS. 15A, 15B, 15C, 16A, 16B and 16C, the dimension of the recording containing portion 22 of the upper case 10 is set different corresponding to the size of the recording sheet 13 in the direction of the ink sheet wind-up shaft but is set the same in the direction orthogonal to the ink sheet wind-up shaft. The portion for containing the ink sheet 12, which is constructed mainly by the lower case 11, has the same dimension D in the direction of the ink sheet wind-up shaft irrespective of the size of the recording sheet and also has the same dimension in the direction orthogonal to the ink sheet wind-up shaft. The positioning holes 35, 36 are provided in the edge surface of the ink sheet containing portion. The cartridge distinguishing protrusion 37 is also provided on the edge surface of the ink sheet containing portion. As illustrated in FIGS. 16A, 16B and 16C, a width dimension of the ink sheet 12 differs corresponding to the size of the recording sheet, however, an entire length of the shaft for winding up the ink sheet 12 is set the same.

A method of assembling the recording sheet/ink sheet integral type cartridge 1 will be described sequentially with reference to FIGS. 3, 4A, 4B, 5 and 6.

Figure 3:
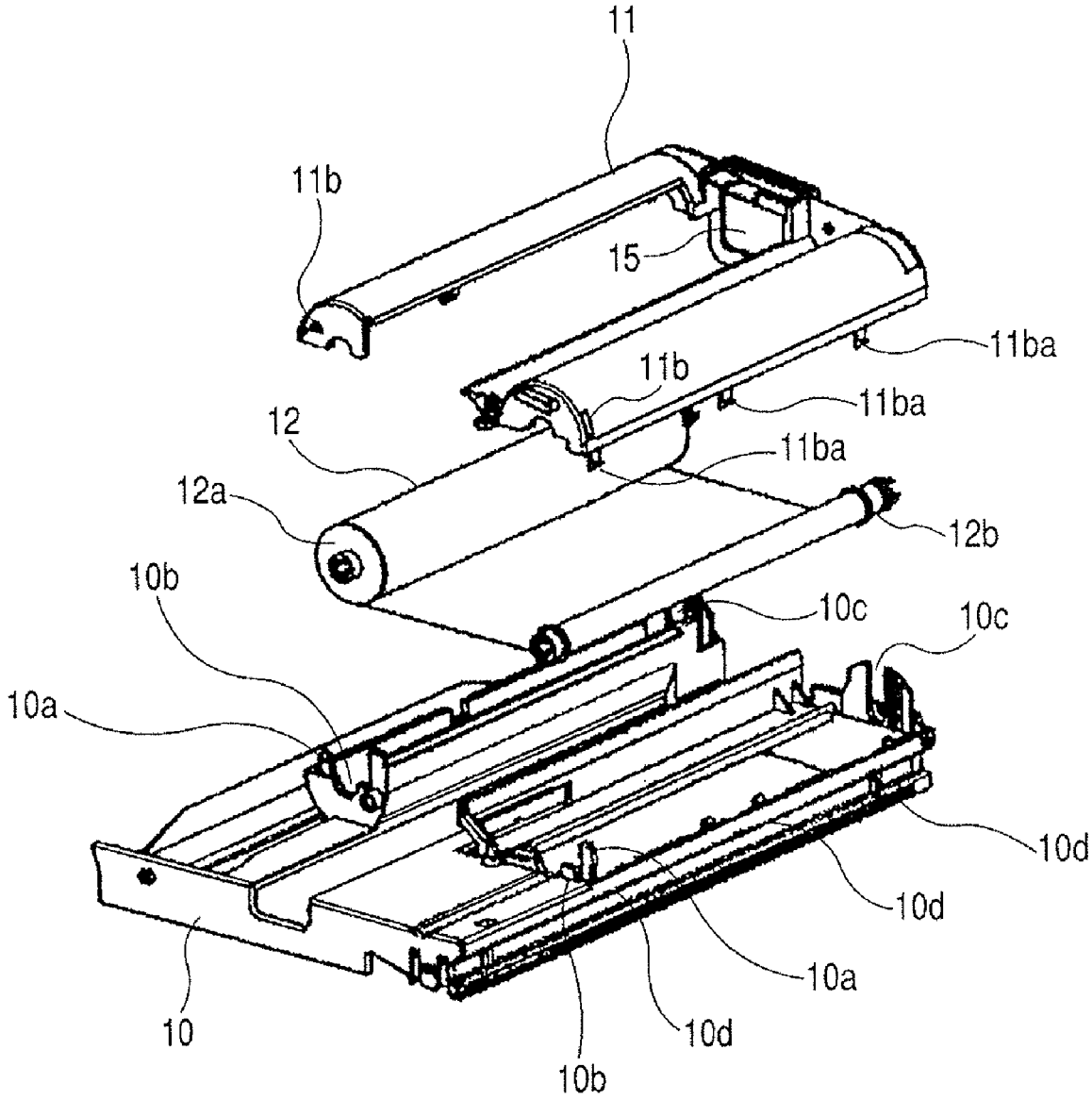
FIG. 3 is an explanatory view of components of the recording sheet/ink sheet integral type cartridge and an assembling method according to the embodiment of the present invention.
Figure 4A:
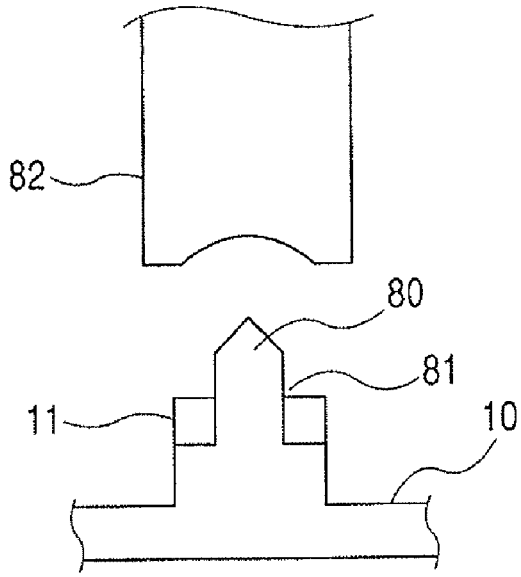
FIGS. 4A and 4B are explanatory views of the components of the recording sheet/ink sheet integral type cartridge and the assembling method according to the embodiment of the present invention.
Figure 4B:
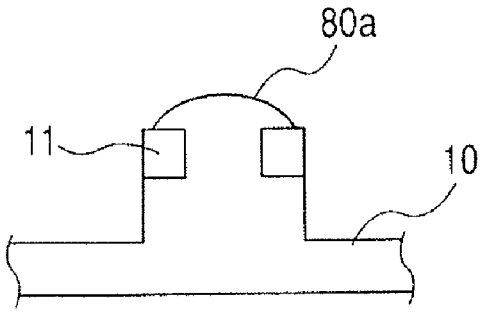

As illustrated in FIG. 3, the recording containing portion 22 of the upper case 10 is set under. In this state, the first bobbin 12*a* and the second bobbin 12*b* for the ink sheet 12 are placed down respectively into a semicircular notch lob and a U-shaped notch 10*c* of the upper case 10. The lower case 11 is assembled from above to the upper case 10. A pawl 10*a* of the upper case 10 engages with a hole 11*b* of the lower case 11, while a pawl 11*ba* of the lower case 11 engages with a hole 10*d* of the upper case 10. The upper case 10 and the lower case 11 are thereby joined together. Though invisible in FIG. 3, similar pawls and holes are disposed on the rear side in FIG. 3, whereby the main portions of the upper case 10 and the lower case 11 are fixed to each other. In the recording sheet/ink sheet integral type cartridge according to the present embodiment, a welding shaft 80 provided at the upper case 10 and a welding hole 81 formed in the lower case 11 are joined by heat welding. Details thereof will be described with reference to FIGS. 4A and 4B. FIG. 4A illustrates a state where the ink sheet 12 and the lower case 11 illustrated in FIG. 3 are assembled to the upper case 10, in which state the welding shaft 80 of the upper case 10 is inserted through the welding hole 81 of the lower case 11. In this state, a tip of the welding shaft 80 is changed in shape by pressing a terminal 82 of a welding tool with a predetermined load against the tip of the welding shaft 80. With this operation, as indicated by 80*a* in FIG. 4B, an outside diameter of the welding shaft 80 gets larger than the welding hole 81. With the tight junction to the lower case 11 from above in the drawings, it follows that the upper case 10 and the lower case 11 surely get joined together. The tip of the terminal 82 of the welding tool illustrated in FIGS. 4A and 4B takes a spherically concave, and hence a post-change shape 80*a* of the welding shaft 80 is spherically convex. If the tip of the terminal 82 is flat, the shape of the welding shaft 80 is changed flat, wherein the same effect can be obtained. The terminal 82 may be either a terminal including a heater or a terminal that emits the heat by vibrating the welding shaft 80 through ultrasonic vibrations. At this time, the tip of the welding shaft 80 before changing the shape takes a conical shape, and therefore the welding shaft 80 is easy to change its shape from the conical tip in any case.

Figure 5:
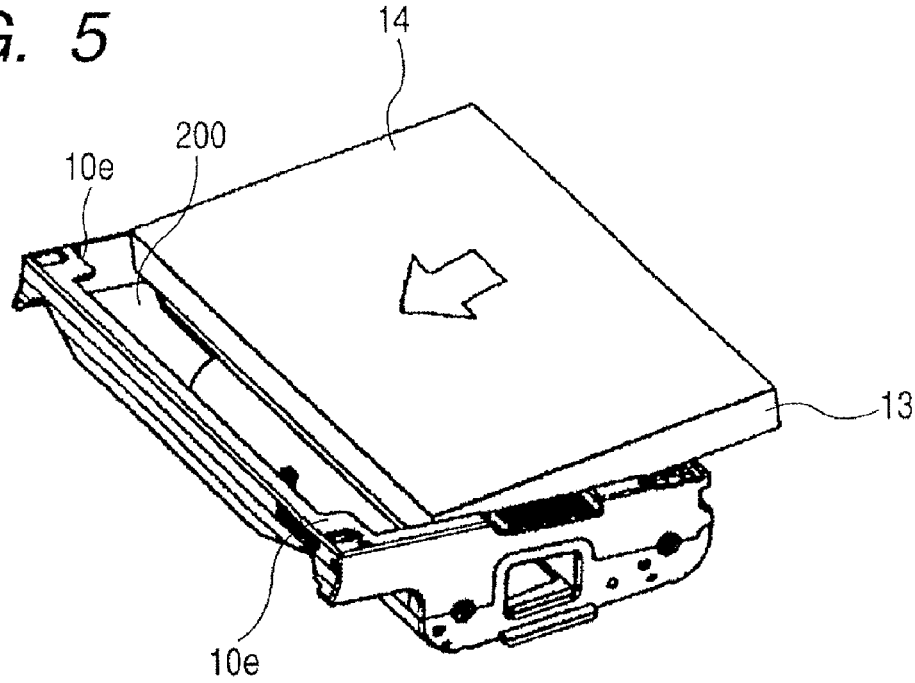
FIG. 5 is an explanatory view of the components of the recording sheet/ink sheet integral type cartridge and the assembling method according to the embodiment of the present invention.
Figure 6:
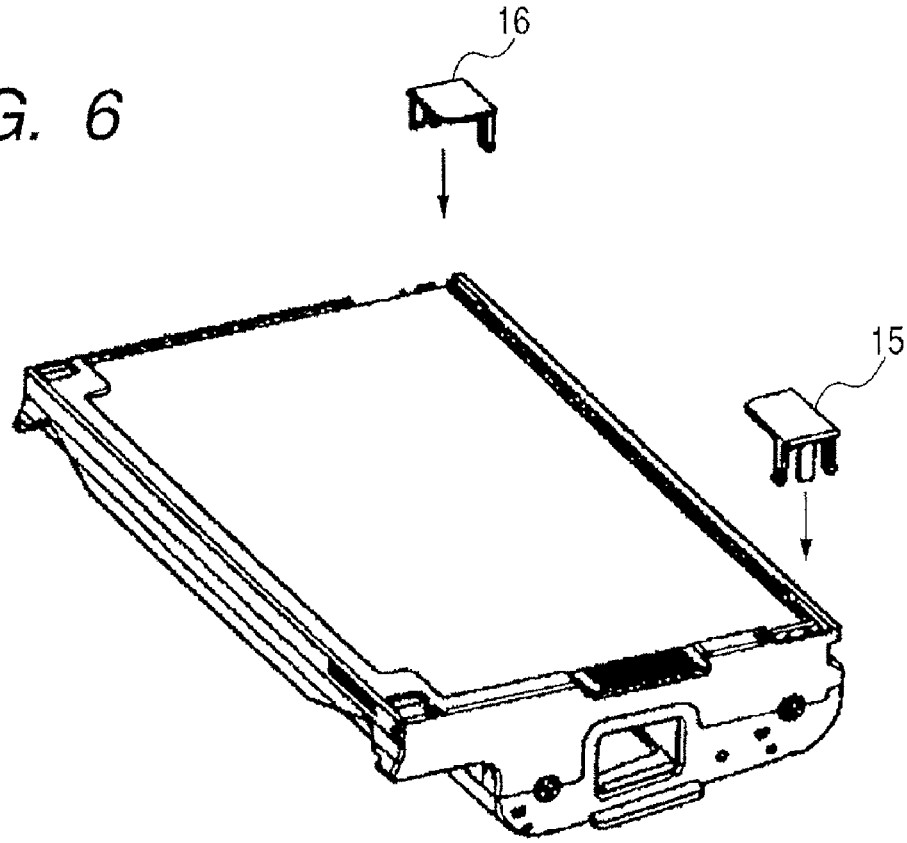
FIG. 6 is an explanatory view of the components of the recording sheet/ink sheet integral type cartridge and the assembling method according to the embodiment of the present invention.

Illustration of how the recording sheet 13 and the protection sheet 14 are contained will be made with reference to FIGS. 5 and 6. After the ink sheets 12 and the lower case 11 have been assembled to the upper case 10, the fifty recording sheets 13 with the protection sheet 14 superposed thereon are inserted into the recording sheet containing portion 22 of the upper case 10 from an upper surface aperture 200 through the backside of two presser portions 10*e* at corners. On this occasion, the recording sheets 13 are prevented by the two separating pawls 31, 32 provided at the corners of the feeding port 30 from dropping out of the feeding port 30. After the recording sheets 13 and the protection sheet 14 have been set in the upper case 10, as illustrated in FIG. 6, presser members 15, 16 are fitted to remaining two corner portions of the upper case 10. This contrivance prevents the recording sheets 13 from dropping from within the recording sheet containing portion 22 because of the four corner portions being held. The presser members 15, 16 are composed of resin and fitted to the upper case 10 by pawls making use of elastic deformation of the resin. As discussed above, in the recording sheet/ink sheet integral type cartridge according to the present embodiment, mainly the two components, i.e., the upper case 10 and the lower case 11, contain the recording sheets and the ink sheets, and the downsizing thereof can be attained without requiring many components.

Figure 7:
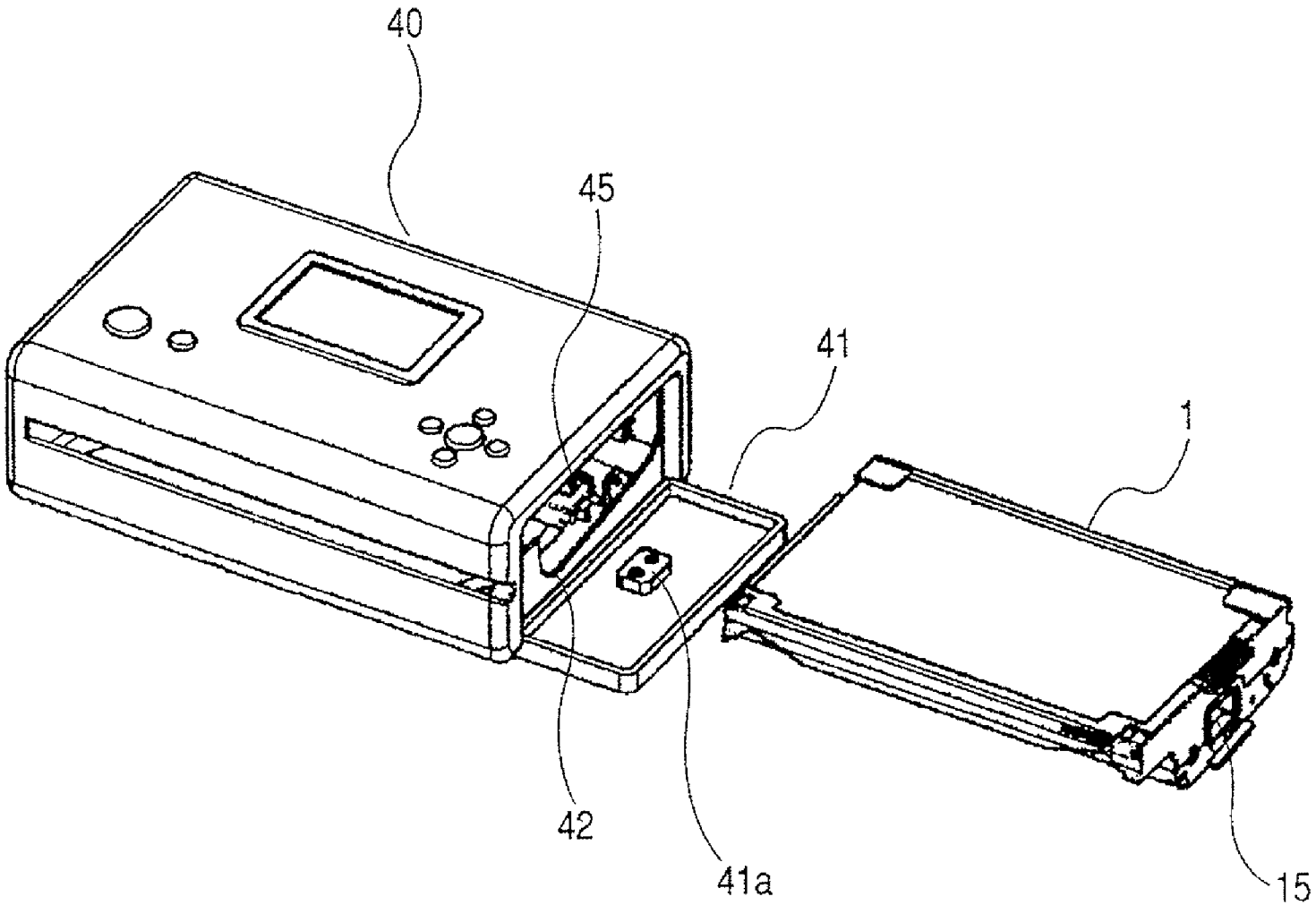
FIG. 7 is an explanatory view of a printer using the recording sheet/ink sheet integral type cartridge and the assembling method according to the embodiment of the present invention.
Figure 8:
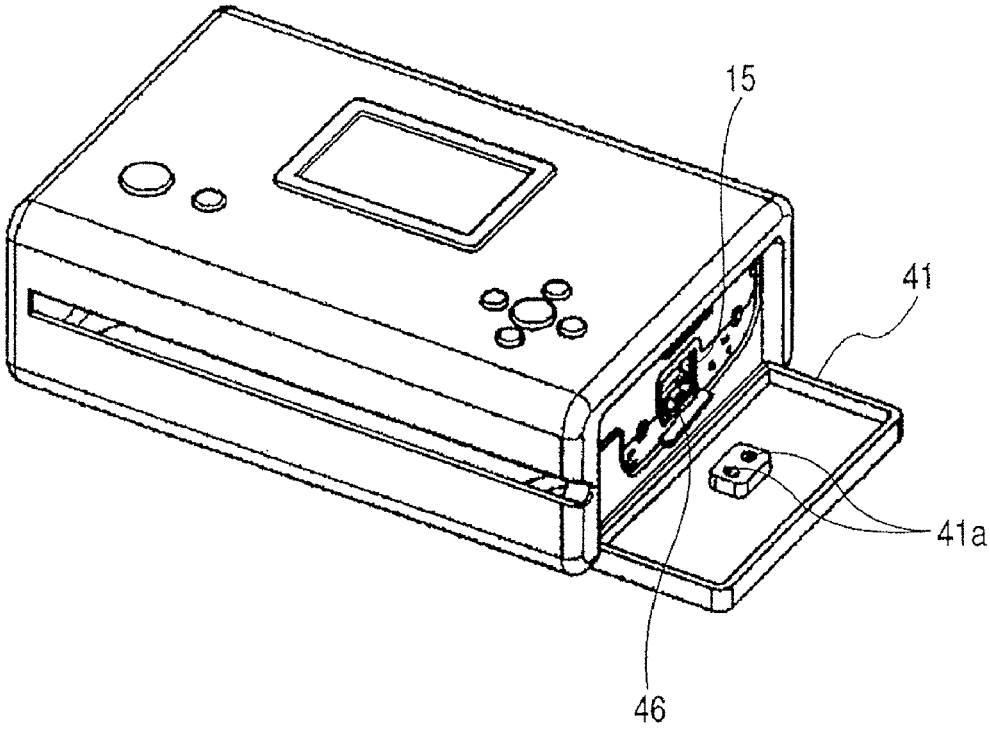
FIG. 8 is an explanatory view of the printer using the recording sheet/ink sheet integral type cartridge and the assembling method according to the embodiment of the present invention.

The printer using the recording sheet/ink sheet integral type cartridge 1 according to the present embodiment will be described with reference to FIG. 7. FIG. 7 illustrates a state in which a door 41 of the side surface of a printer body 40 opens, wherein a cartridge insertion port 42 is exposed. The cartridge insertion port 42 is a port taking substantially the same shape as and being larger by one size than the sectional shape of the cartridge 1. An edge of a head unit 45 is visible within the cartridge insertion port 42. FIG. 8 illustrates a state of how the cartridge 1 is inserted into the cartridge insertion port 42. As illustrated in FIG. 8, when the cartridge 1 is inserted into the printer body, the leading edge of the head unit 45 gets slightly exposed from the aperture 15 of the cartridge 1. Then, a shaft 46 provided at the leading edge of the head unit 45 gets protruded by a predetermined quantity from the cartridge 1. In this state, when the door 41 is closed, an engagement hole 41*a* formed in an internal surface of the door 41 is fitted on the shaft 46, thereby regulating a position of the leading edge of the head unit 45 and enabling the printer to be used.

Figure 9:
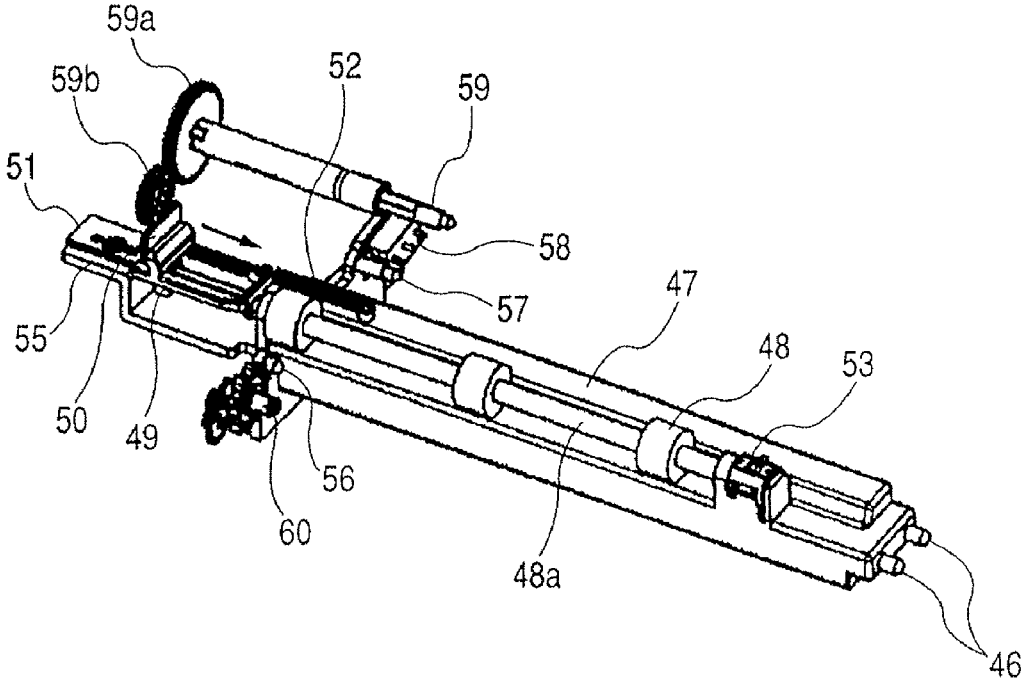
FIG. 9 is an explanatory view of a thermal head unit provided in a printer body illustrated in FIGS. 7 and 8.

FIG. 9 is a perspective view of the thermal head unit 45 of the printer employing the recording sheet/ink sheet integral type cartridge 1 according to the present embodiment. A thermal head 47 is electrically connected to a print control board (unillustrated) within the printer body. A sheet feeding roller 48 has a shaft 48*a* of which both ends are rotatably axially supported on the head unit 45. One end of the shaft 48*a* is fitted with a gear 49 in a way that rotates integrally with the shaft 48*a*, and the sheet feeding roller 48 is rotationally driven by an unillustrated interlocking gear.

An urging member 50 serves to urge the recording sheet in the cartridge in an arrowhead direction in the drawings. A leading edge of the urging member 50 is fitted to the shaft 48*a*, and the other edge thereof is held, slidably in attaching/detaching directions of the cartridge, to a rail 51 fixed to a head frame 55. The urging member 50 is thus urged by a spring 52 toward the cartridge insertion port 42.

Figure 10:
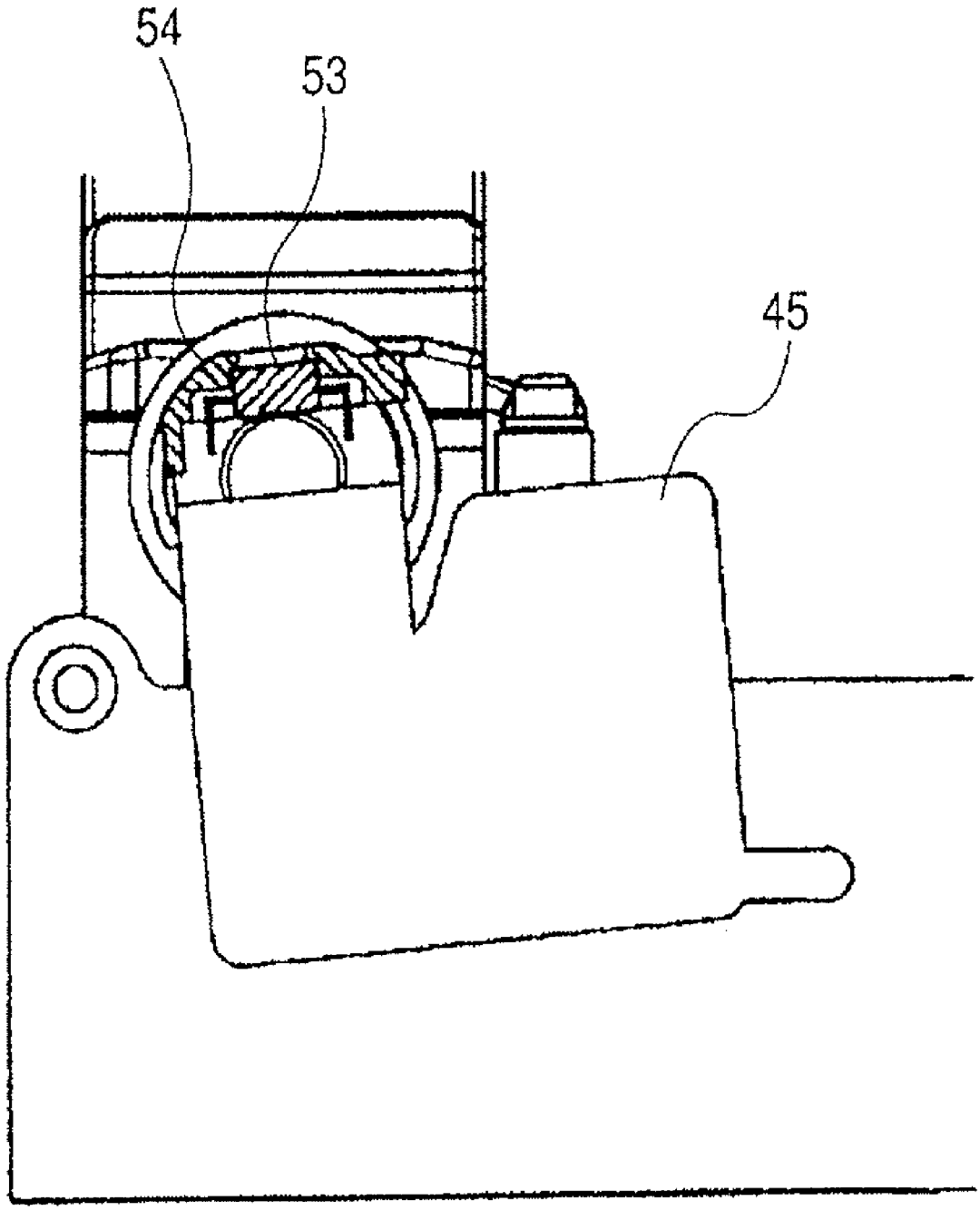
FIG. 10 is a sectional view illustrating a state of fitting a photo reflector of the thermal head unit.

The head unit 45 has a photo reflector 53, secured by a holder 54, for detecting existence or none-existence of the recording sheets within the cartridge. FIG. 10 illustrates a sectional view of a state of how the photo reflector 53 is secured. As illustrated in FIG. 10, the photo reflector 53 is, with its light projecting portion and light receiving portion being directed upward, secured to the head unit 45. The holder 54 is covered from above, thereby fixing the photo reflector 53.

Referring back to FIG. 9, a first positioning shaft 56 and a second positioning shaft 57 serve to position the cartridge 1 when the cartridge 1 is loaded into the printer body. The first positioning shaft 56 and the second positioning shaft 57 are, when the cartridge 1 is loaded into the printer body, fitted into the first positioning hole 35 and the second positioning hole 36 (FIG. 1) formed in the cartridge 1, thus regulating the position of the cartridge 1 within the printer body.

A cartridge distinguishing switch 58 serves to distinguish between the types of the cartridges. The cartridge distinguishing switch 58 distinguishes between the types of the cartridges according to the protruded shape 37 (FIGS. 1, 15A, 15B and 15C) provided on the cartridge 1 when the cartridge 1 is loaded into the printer body.

A wind-up shaft 59, when the cartridge 1 is loaded into the printer body, engages with the second bobbin 12*b* (FIGS. 2 and 3) of the cartridge 1 and winds up the ink sheet 12 when printing. The wind-up shaft 59 connects to gears 59*a*, 59*b* and is controlled to rotate at a predetermined speed when performing the printing operation. A driven shaft 60 is rotated when the ink sheet 12 is wound up. The driven shaft 60 serves to detect, e.g., the rotating operation and to check whether the ink sheet 12 is surely supplied or not.

Figure 11:
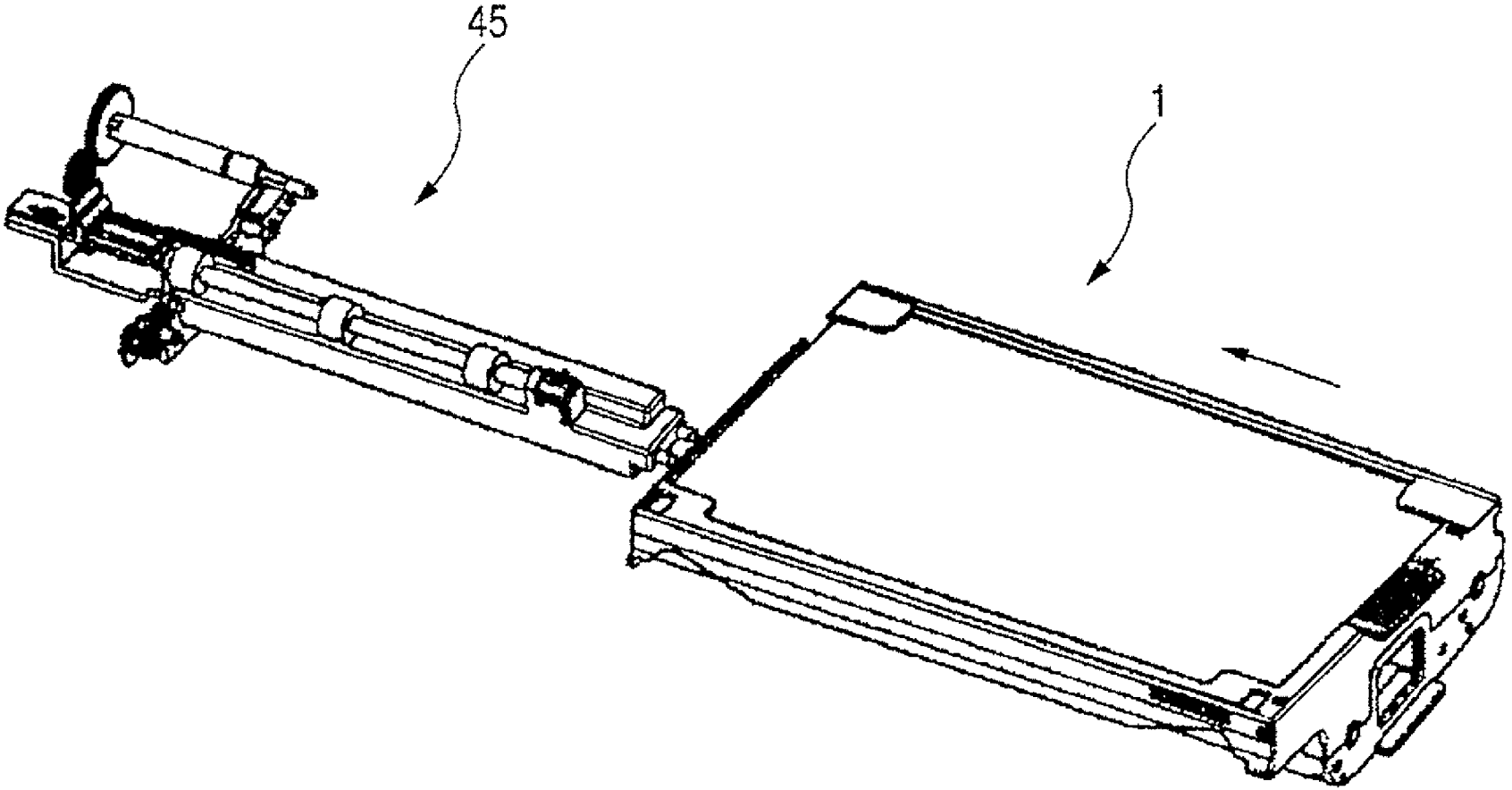
FIG. 11 is a view illustrating a state of how the integral type cartridge is loaded with respect to the thermal head unit into the printer body.
Figure 12:
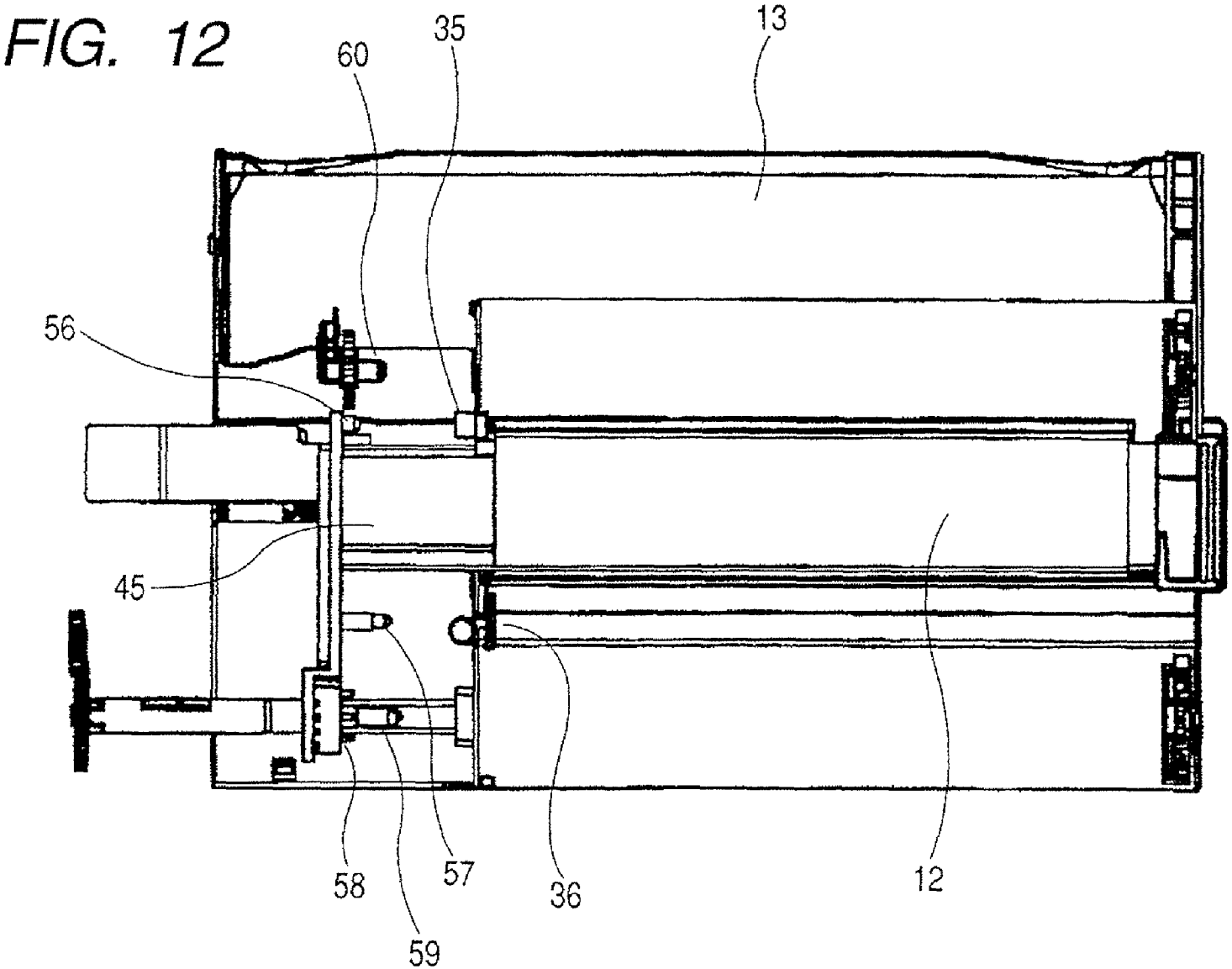
FIG. 12 is a view illustrating the state in which the integral type cartridge is loaded with respect to the thermal head unit into the printer body.
Figure 13:
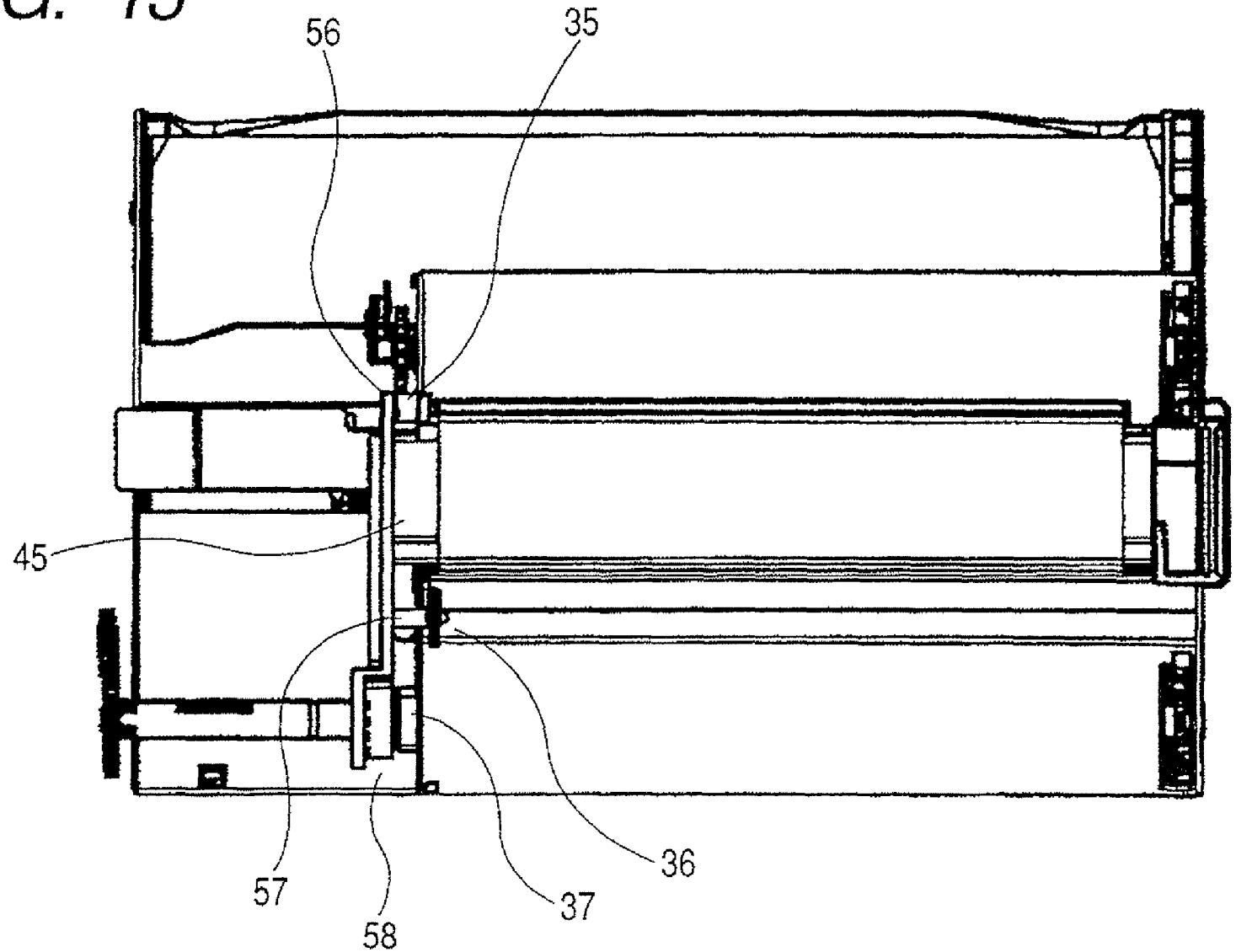
FIG. 13 is a view illustrating the state in which the integral type cartridge is loaded with respect to the thermal head unit into the printer body.
Figure 14:
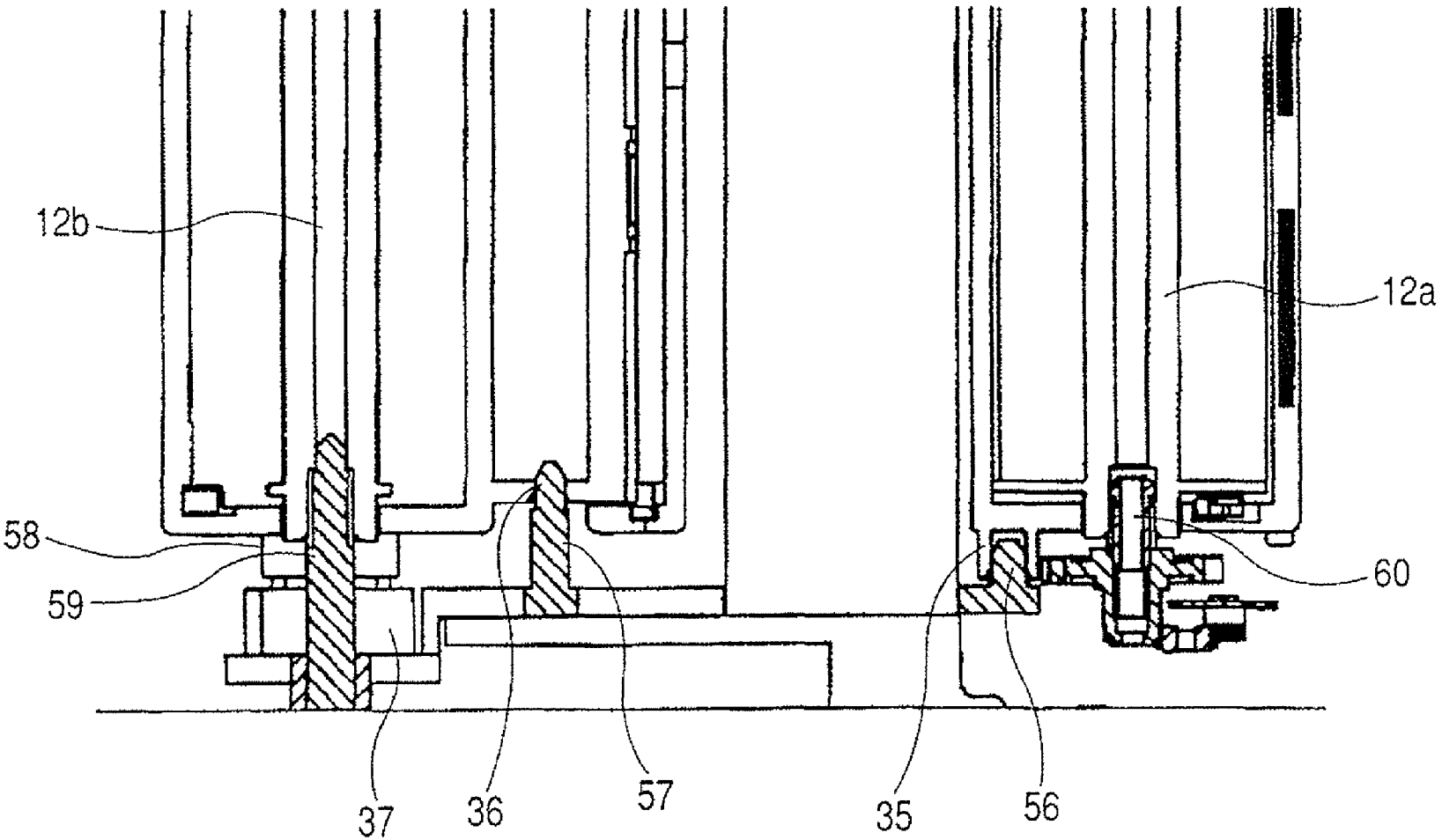
FIG. 14 is a view illustrating the state in which the integral type cartridge is loaded with respect to the thermal head unit into the printer body.
Figure 15A:
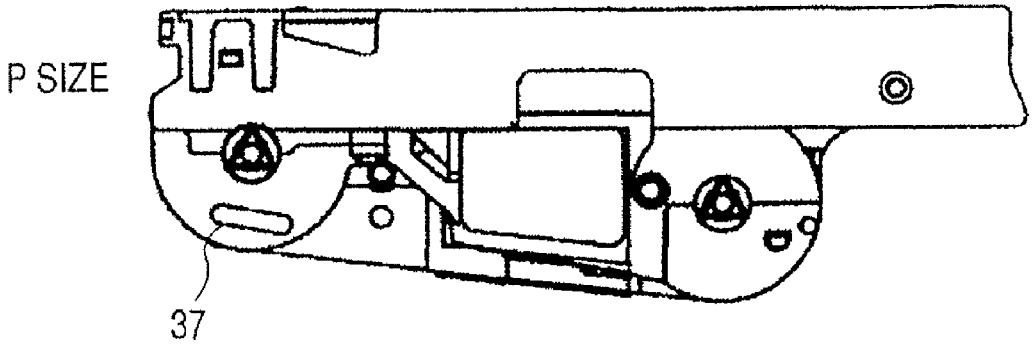
FIGS. 15A, 15B and 15C are views illustrating three types of recording sheet/ink sheet integral type cartridges corresponding to different sizes of recording sheets according to the embodiment of the present invention.
Figure 15B:
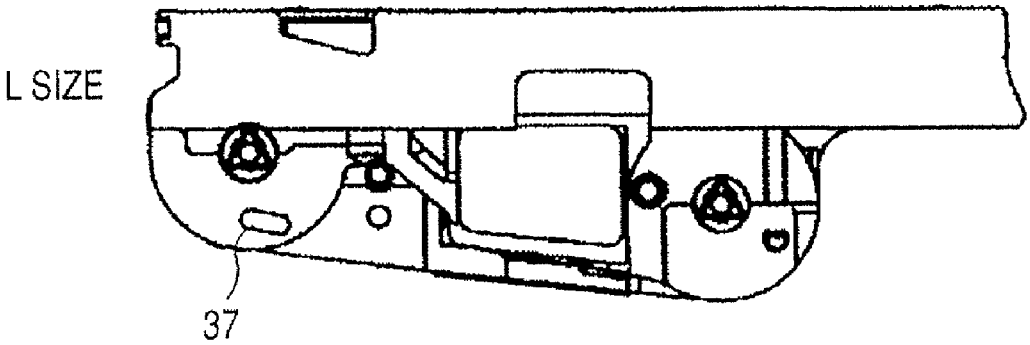
Figure 15C:
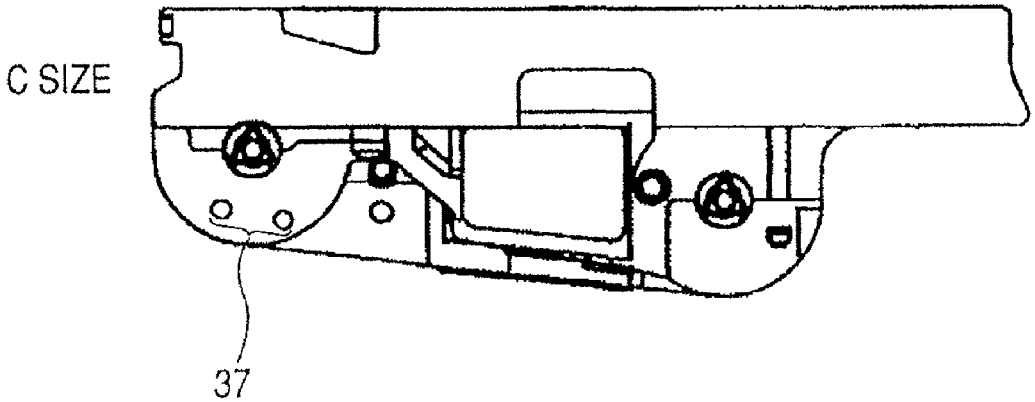

The thus-described head unit 45 is installed within the printer body 40. A state of how the cartridge 1 is loaded stepwise into the head unit 45 will be described with reference to FIGS. 11, 12 and 13. The cassette 1 is loaded into the head unit 45 within the printer body 40 in an arrowhead direction in FIG. 11. At this time, it follows that the head unit 45 enters the space area 33 between the ink sheet 12 and the recording sheet 13 that are illustrated in FIG. 2. FIG. 12 a view illustrating the state of this operation as viewed from the backside of the cartridge 1. As illustrated in FIG. 12, the head unit 45 enters the space area 33 at a point higher than the ink sheet 12 but lower than the recording sheet 13. FIG. 13 illustrates a state where the cartridge 1 is completely loaded. FIG. 14 is a sectional view giving an in-depth illustration thereof. As illustrated in FIGS. 13 and 14, the first positioning shaft 56 is fitted in the first positioning hole 35, while the second positioning shaft 57 is fitted in the second positioning hole 36. The wind-up shaft 59 is fitted in the second bobbin 12*b*, while the driven shaft 60 is fitted in the first bobbin 12*a*. The cartridge distinguishing switch 58 is pressed by the cartridge distinguishing protrusion 37.

The positioning holes 35, 36 and the cartridge distinguishing protrusion 37 are situated in positions common to each other even in a different case of the type of the cartridge 1. Hence, there is no necessity of providing the positioning shafts 56, 57 and the plurality of cartridge distinguishing switches 58 on the side of the printer body 40. There is also no necessity of making variable the entire lengths and the positions of the wind-up shaft 59 and the driven shaft 60 because of the entire lengths and the arrangement of the first bobbin 12*a* and the second bobbin 12*b* being the same. Thus, even the cartridge having the plural sizes of recording sheets or the cartridge having the plural sizes of ink sheets 12 enables the internal construction of the printer body to be simplified by setting the external shape in the same dimension. Namely, the internal construction of the printer body can be simplified by commonizing the external shape of the ink sheet containing portion, the positions of the positioning holes 35, 36 and of the cartridge distinguishing protrusion 37 and the entire lengths of the first bobbin 12*a* and of the second bobbin 12*b*.

Figure 17:
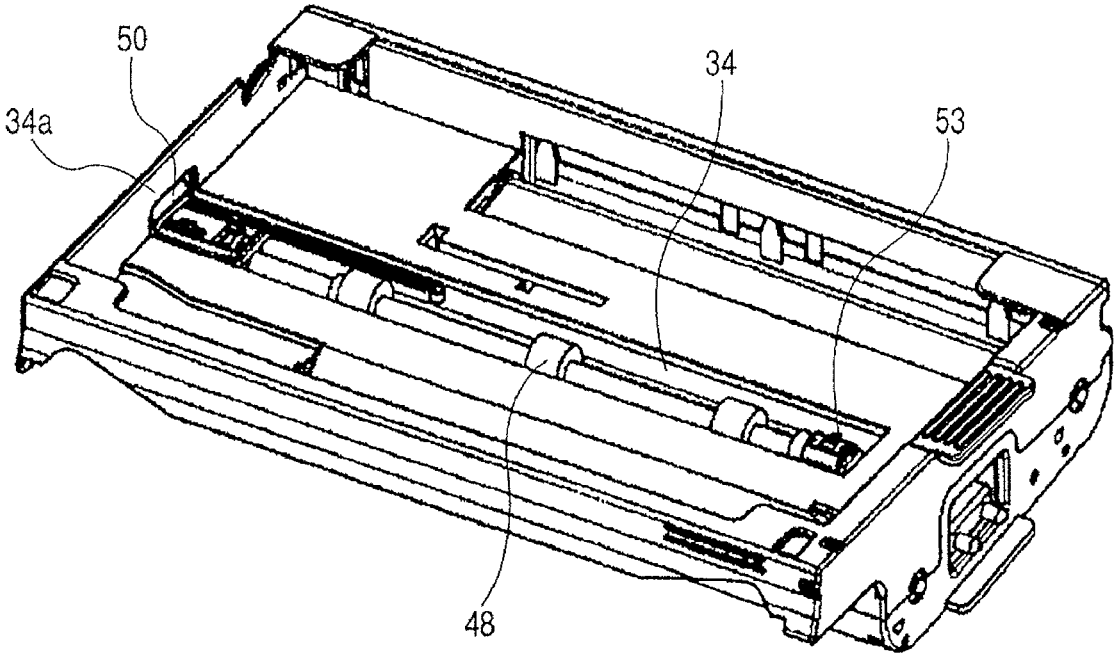
FIG. 17 is a view illustrating a state of removing a protection sheet in a state of loading the integral type cartridge into the printer body.

FIG. 17 illustrates the state in which the cartridge 1 is completely loaded into the printer body 40 but does not illustrate the recording sheet 13 and the protection sheet 14 for facilitating the comprehension. As illustrated in FIG. 17, the sheet feeding roller 48 and the photo reflector 53 are situated within the aperture 34 of the upper case 10. The urging member 50 provided on the head unit is situated inside of the side surface aperture 34*a*.

Figure 18:
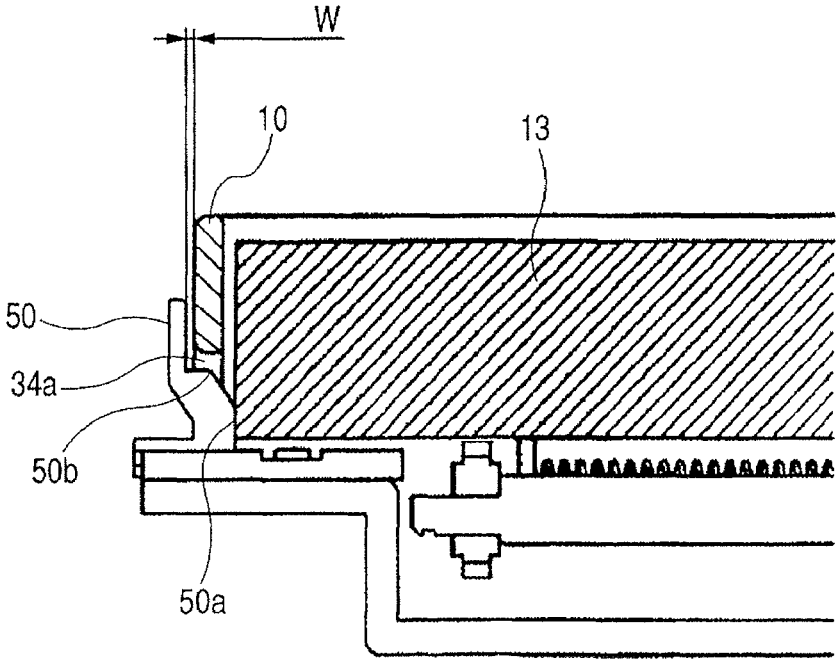
FIG. 18 is a sectional view illustrating a positional relationship between an urging member (one-side aligning member) according to the present invention, the cartridge and the recording sheet.

FIG. 18 is a sectional view illustrating a positional relationship between the urging member 50, the cartridge 1 and the recording sheet 13. In FIG. 18, the urging member 50 is, as described above, urged by the spring 52 (FIG. 9) in the right direction in FIG. 18, wherein an abutting surface 50*a* thereof protrudes into the interior of the upper case 10 from the side surface aperture 34*a* and abuts on the edge surface of the recording sheets 13. In this abutting state, the urging member 50, with a gap w being provided without abutting on the outside surface of upper case 10, surely aligns the recording sheets 13 one-sidedly in the right direction (toward the cartridge insertion port 42) in FIG. 18.

An oblique surface 50*b* formed on the urging member 50 serves to guide the recording sheets 13 fed sequentially from the lowest recording sheet in FIG. 18 to the abutting surface 50*a* in a way that smoothly moves the recording sheets 13 downwardly from above.

An operation of the urging member 50 will be described.

Figure 20A:
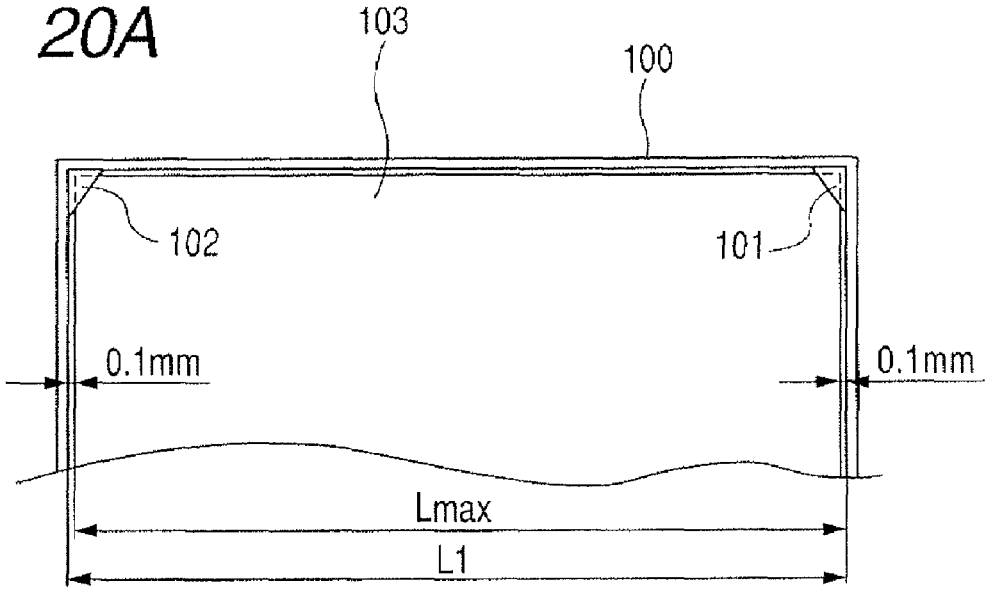
FIGS. 20A and 20B are views illustrating a relationship between the separating pawls and the recording sheet in the example of the cartridge in the case of adopting none of the urging member (one-side aligning member) according to the present invention.
Figure 20B:
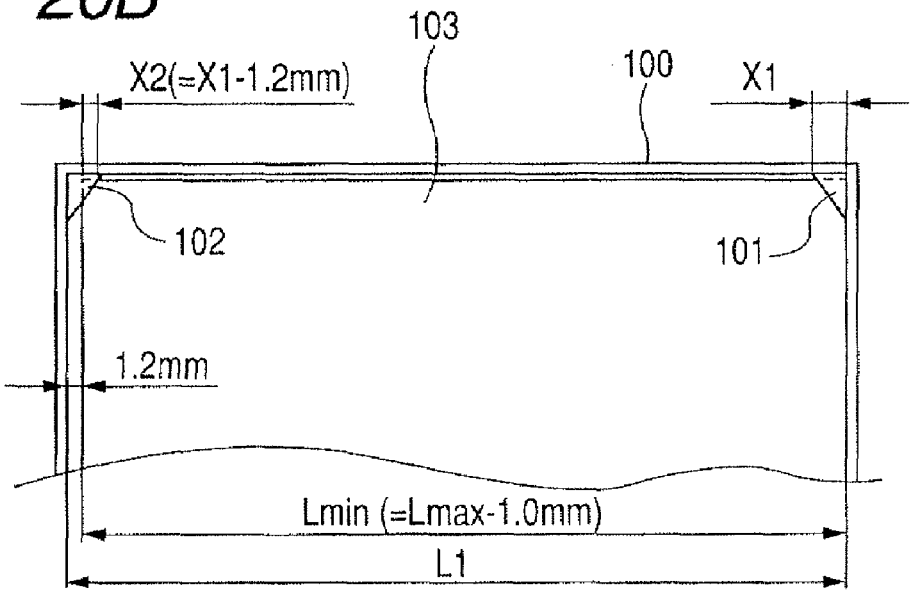

FIGS. 20A and 20B are diagrams simplified for providing an easy-to-understand relationship between the separating pawls and the recording sheet in the example of the cartridge in a case that does not adopt the urging member 50. FIG. 20A illustrates an upper case 100, separating pawls 101, 102 and a recording sheet 103. The two corners of the leading edge of the recording sheet 103 in the feeding direction abut on the separating pawls 101, 102. Generally, the recording sheet involves occurrence of an error when cutting the sheet and therefore has tolerances in a lengthwise dimension and in a crosswise dimension. An inside dimension L1 of the recording sheet containing portion of the upper case 100 is required to have a gap with respect to a maximum tolerance (Lmax) of the dimension of the recording sheet in the longitudinal direction thereof. Hence, if the dimension L of the recording sheet in the (widthwise) direction orthogonal to the feeding direction is a minimum tolerance, it follows that the gap increases. FIG. 20B illustrates the recording sheet of which the widthwise dimension L is the minimum tolerance (Lmin) of the dimension and also illustrates a state in which the recording sheet is aligned one-sidedly to the right hand in FIG. 20B within the cartridge 100. In this case, it follows that a widthwise length X1 of a contact area between the right-side separating pawl 101 and the recording sheet 103 is largely different from a width-directional length X2 of a contact area between the left-side separating pawl 102 and the recording sheet 103. For example, as illustrated in FIG. 20B, when the tolerance of the longitudinal dimension L of the recording sheet is ±0.5 mm, a dimensional difference between the recording sheet having the maximum dimensional tolerance (Lmax) and the recording sheet having the minimum dimensional tolerance (Lmin) is on the order of 1.0 mm. Supposing that an allowance of the inside dimension of the cartridge 100 is set to 0.1 mm on every one side, it follows that a gap of 1.2 mm occurs in the recording sheet having the minimum dimensional tolerance (Lmin). Hence, there occurs a difference of 1.2 mm between the widthwise lengths X1 and X2 of the contact areas of the separating pawls 101, 102 with the recording sheet.

None of problems occur if the widthwise length of the contact area of the separating pawl with the recording sheet is large enough to make this difference ignorable. In the case of using the recording sheet having such a size and a quality as to print a photo, however, a considerably large separating pawl can not be employed in terms of taking account of a load of the drive for separation and a damage to the recording sheet. It is therefore difficult to use the separating pawl that is large enough to make the difference of 1.2 mm ignorable. A difference between the separation timings when separating the recording sheets increases, and, in the worst case, such a failure arises that the recording sheets can not be separated.

Figure 19A:
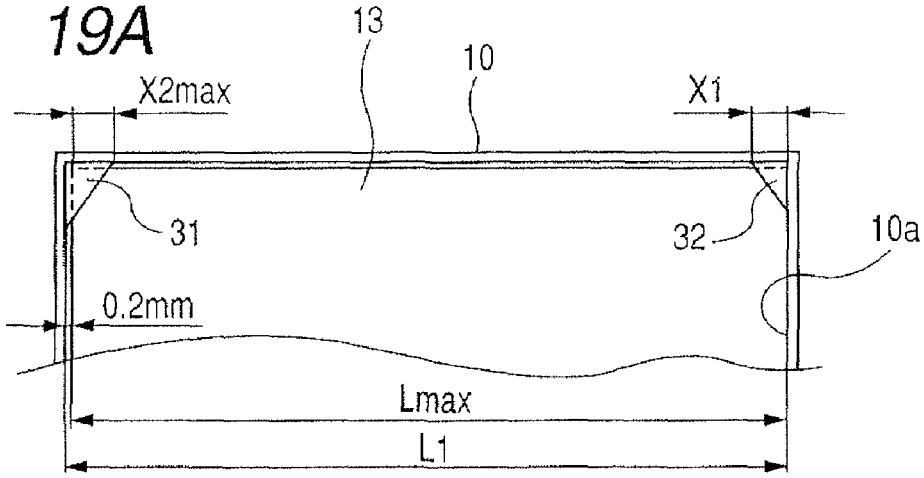
FIGS. 19A, 19B and 19C are views illustrating a relationship between the separating pawls and the recording sheet in the example of the cartridge in the case of adopting the urging member (one-side aligning member) according to the present invention.
Figure 19B:
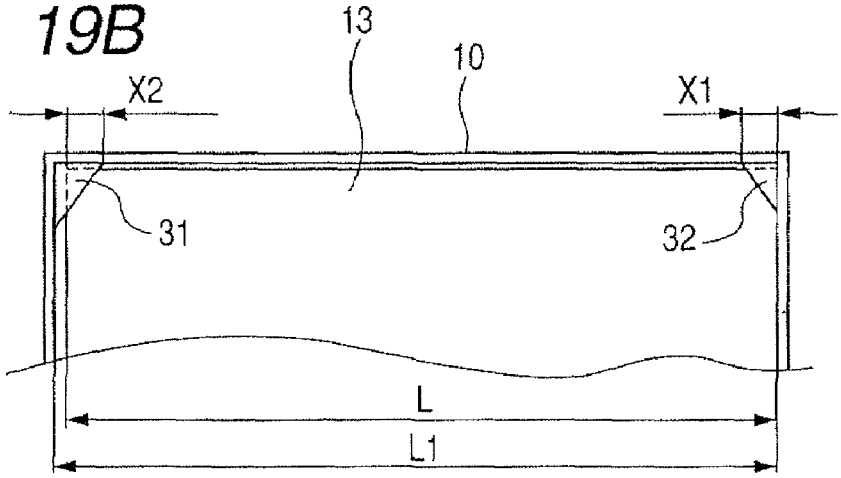
Figure 19C:
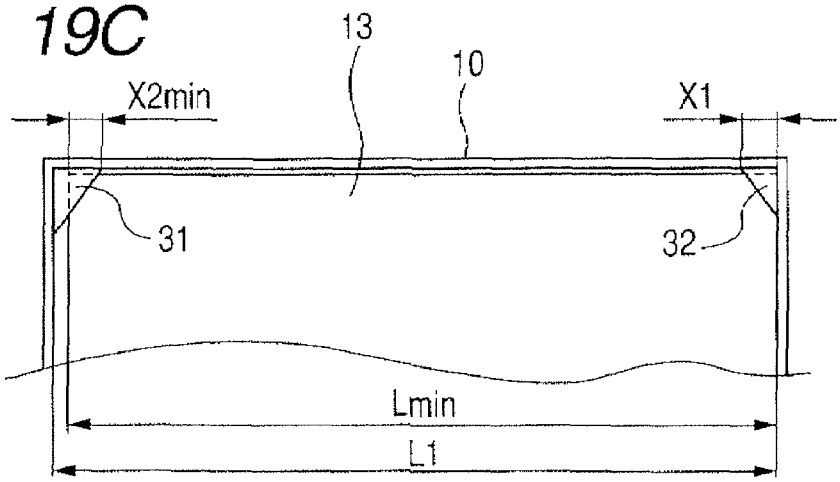

The urging member 50 (a one-side aligning member) suited to the cartridge 1 according to the present invention will be described with reference to FIGS. 19A, 19B and 19C. FIGS. 19A, 19B and 19C are diagrams that are likewise simplified for providing the easy-to-understand relationship between the separating pawls and the recording sheet. FIGS. 19A, 19B and 19C are the diagrams as viewed from the feeding port 30 of the cartridge 1 and illustrating the relationship between the recording sheet 13 and the separating pawls 31, 32, wherein the corners of the leading edge of the recording sheet 13 in the sheet feeding direction are caught by the separating pawls 31, 32. FIG. 19A illustrates the case where the longitudinal dimension L of the recording sheet is the maximum tolerance (Lmax). At this time, a longitudinal dimension L1 of the recording sheet containing portion of the upper case 10 is set capable of containing the recording sheets with an allowance even when the longitudinal dimension L of the recording sheet 13 is the maximum tolerance. The present example is that the longitudinal dimension L1 is set capable of having a gap of 0.2 mm as illustrated in FIG. 19A when the longitudinal dimension L of the recording sheet 13 is the maximum tolerance.

FIG. 19B illustrates a case in which the longitudinal dimension L of the recording sheet is a nominal dimension. FIG. 19C illustrates a case in which the longitudinal dimension L of the recording sheet is the minimum tolerance (Lmin). In FIGS. 19A, 19B and 19C, the left direction as viewed in every drawing is the loading direction of the cartridge 1, and the right direction as viewed therein is the direction of ejecting the cartridge 1 out of the printer body. Hence, the recording sheets 13 are aligned by the unillustrated urging member 50 (the one-side aligning member) one-sidedly to the right hand from the left as viewed in FIGS. 19A, 19B and 19C and abut on an internal wall 10*a* (a regulating member) of the upper case 10 on the right side as viewed therein.

As to sizes of the separating pawls 31, 32, when the longitudinal dimension L of the recoding sheet 13 is the nominal dimension as illustrated in FIG. 19B, the separating pawl 31 is set larger than the separating pawl 32 so as to equalize the widthwise lengths X1 and X2 of the contact areas of the separating pawls with the one-sidedly aligned recording sheets 13. The sizes of the separating pawls 31, 32 are thus set, and the recording sheets 13 are aligned one-sidedly on the side of the separating pawl 32. Hence, when the longitudinal dimension L of the recoding sheet 13 has a scatter within the tolerances, the difference between the widthwise lengths X1 and X2 of the contact areas of the separating pawls 31, 32 with the recording sheet 13 is equal to or smaller than the tolerance of the longitudinal dimension L.

For instance, as illustrated in FIG. 19A, when being the maximum tolerance (Lmax) of the recording sheet, a widthwise length X2 max of the contact area of the separating pawl 31 with the recording sheet gets larger by the tolerance of the longitudinal dimension L of the recoding sheet 13 than a widthwise length X1 of the contact area of the separating pawl 32. If the tolerance of the longitudinal dimension L is on the order of ±0.5 mm, X2 max is larger by 0.5 mm than X1.

Wile on the other hand, when being the minimum tolerance (Lmin), a widthwise length X2 min of the contact area of the separating pawl 31 with the recording sheet gets smaller by the tolerance of the widthwise dimension L of the recoding sheet 13 than the widthwise length X1 of the contact area of the separating pawl 32 with the recording sheet. As a result, the widthwise length X2 min of the contact area of the separating pawl 31 with the recording sheet becomes smaller by 0.5 mm than the widthwise length X1 of the contact area of the separating pawl 32 with the recording sheet.

In the case of using none of the urging member 50 (the one-side aligning member), a difference of 1.2 mm between the widthwise lengths of the contact areas of the separating pawls with the recording sheet occurred on the right and left sides. By contrast, in the case of using the urging member 50, the difference between the widthwise lengths of the contact areas of the separating pawls with the recording sheet can be restrained down to 0.5 mm that is the dimensional tolerance of the recording sheet. The difference between the widthwise lengths of the contact areas of the separating pawls provided at the right and left corners with the recording sheet can be minimized. The difference between the separation timings when the recording sheets are separated by the pawls can be reduced, and the failure such as the separation-disabled state can be restrained.

Figure 32:
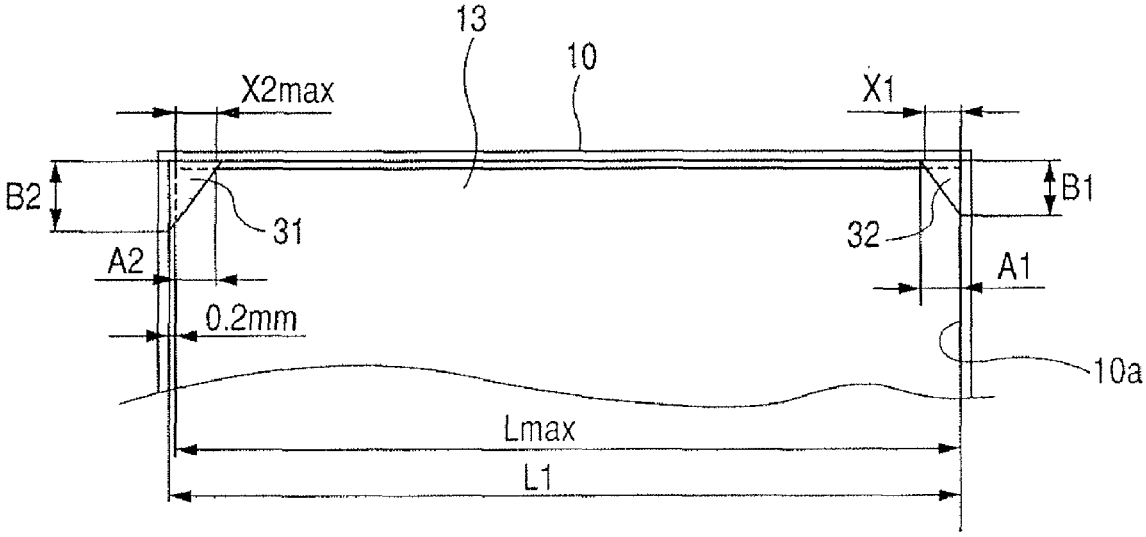
FIG. 32 is a view of a comparison between sizes of the right and left separating pawls in the embodiment of the present invention.
Figure 33A:
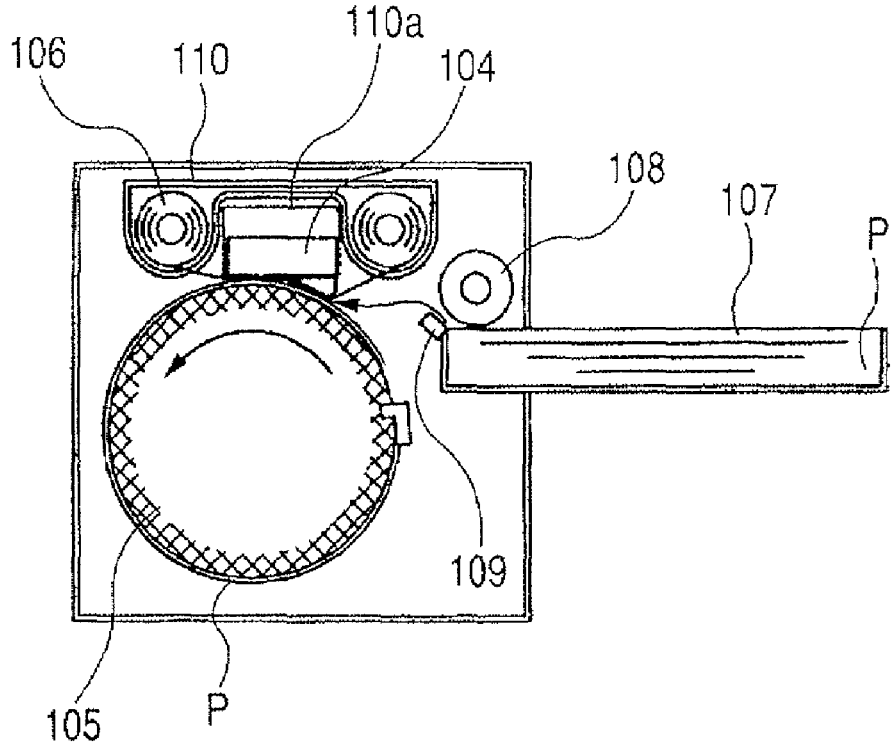
FIGS. 33A and 33B are sectional views illustrating a first example of a general construction of a conventional thermal transfer printer.
Figure 33B:
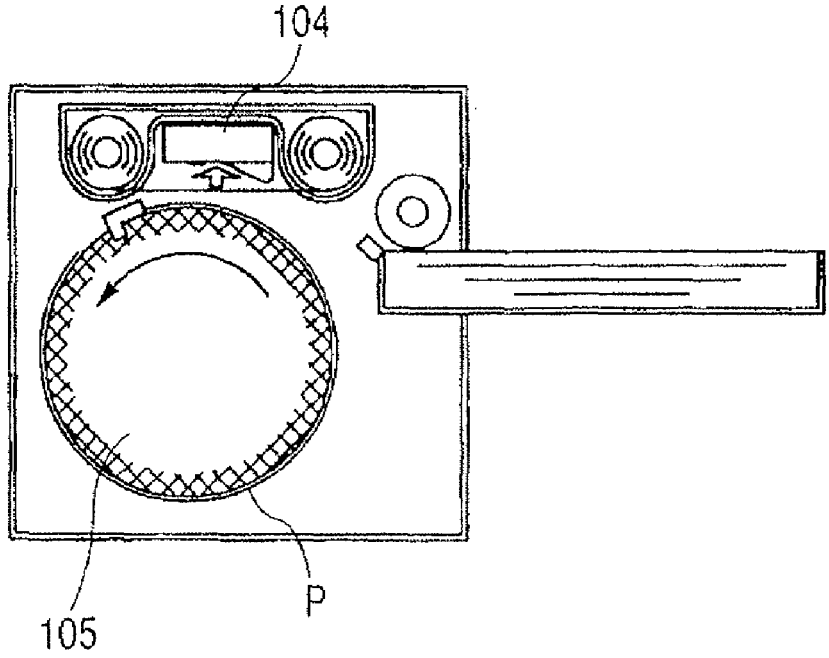
Figure 34A:
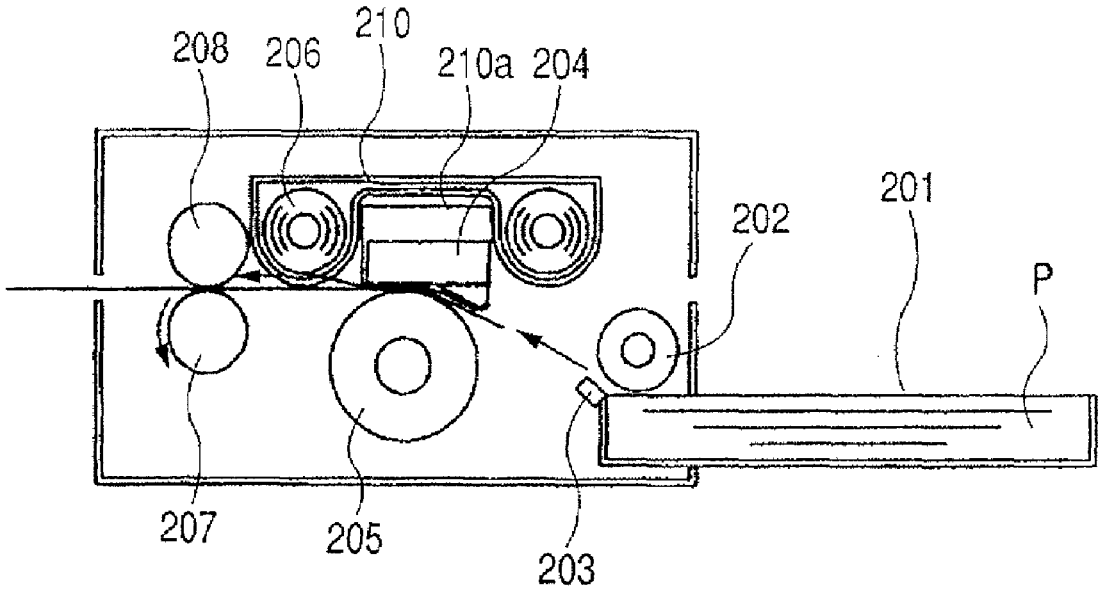
FIGS. 34A and 34B are sectional views illustrating a second example of the general construction of the conventional thermal transfer printer.
Figure 34B:
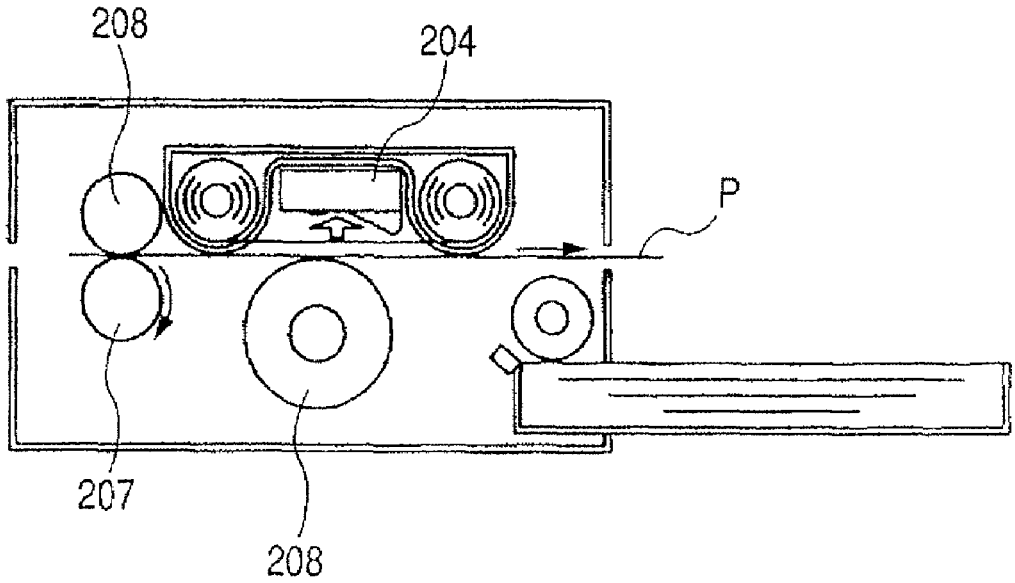
Figure 35A:
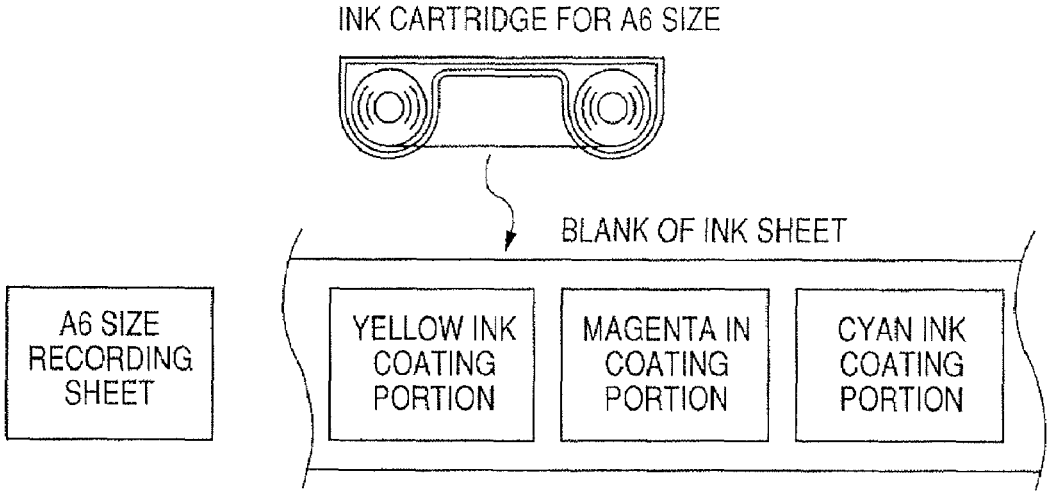
FIGS. 35A and 35B are views illustrating various sizes of recording sheets and ink sheet cartridges that are employed for the conventional thermal transfer printer.
Figure 35B:
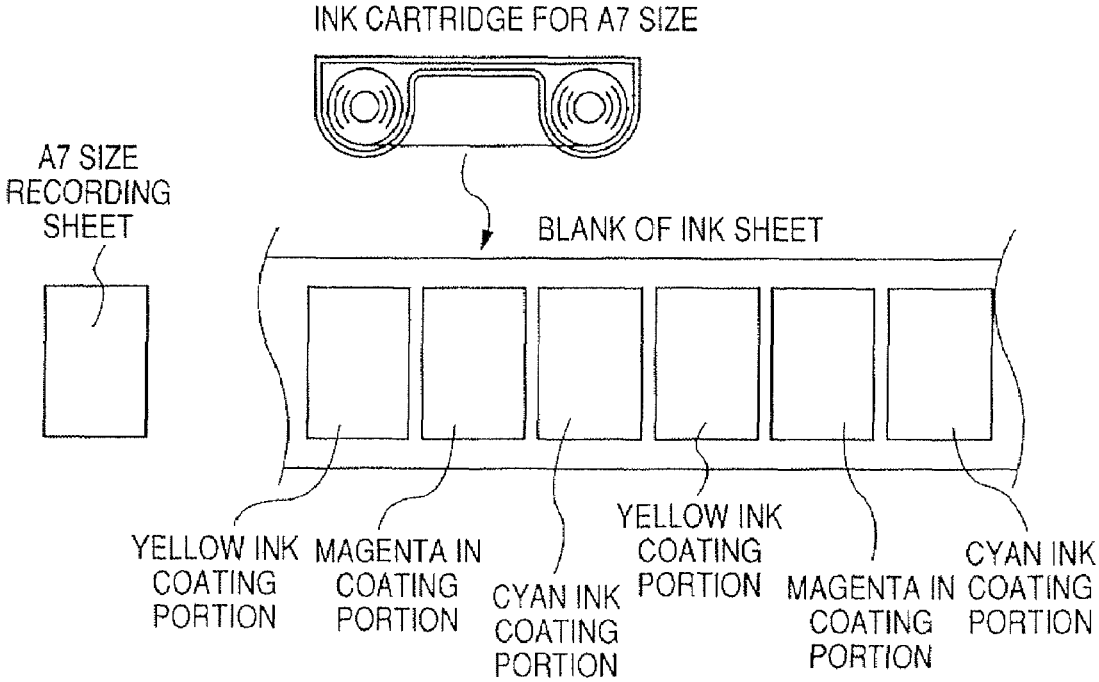

FIG. 32 illustrates the sizes of the left and right separating pawls 31, 32. The recording sheet 13 is pressed against the regulating member 10*a* by the urging member 50. The first separating pawl 32 on the side of the regulating member 10*a* is smaller than the second separating pawl 31 on the opposite side.

A length A1 of the first separating pawl 32 in the direction (widthwise direction) orthogonal to the sheet feeding direction is shorter than a widthwise length A2 of the first separating pawl 31.

$$A1<A2$$

A length B1 of the first separating pawl 32 in the sheet feeding direction is shorter than a length B2 of the first separating pawl 31 in the sheet feeding direction.

$$B1<B2$$

An area of the surface of the first separating pawl 32 that faces the recording sheet 13 is smaller than an area of the surface of the second separating pawl 32 that faces the recording sheet.

$$(A1\times B1)/2<(A2\times B2)/2$$

Figure 21:
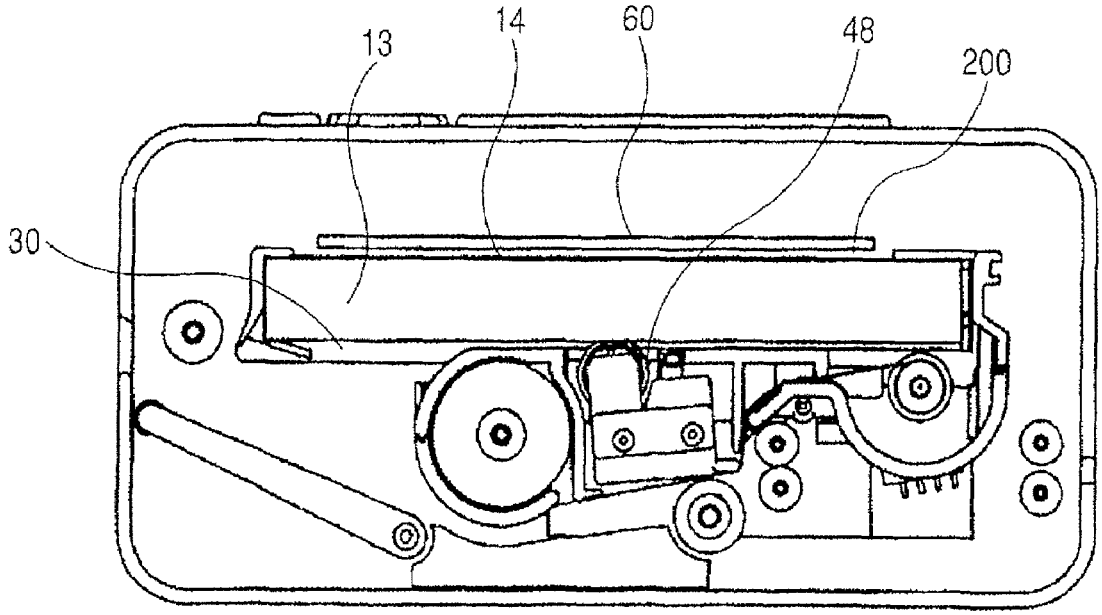
FIG. 21 is an explanatory view of an operation of the printer apparatus according to the embodiment of the present invention.

An operation of the printer apparatus loaded with the recording sheet/ink sheet integral type cartridge 1 according to the present embodiment, will be described with reference to FIGS. 21 through 27. FIG. 21 illustrates a pre-printing standby state in which the cartridge 1 is loaded into the printer body 40. A pressure plate 60 presses, when feeding the sheets, the recording sheet 13 toward the sheet feeding roller 48. The state in FIG. 21 is a print standby state, and hence the pressure plate 60 is situated in a position spaced away from the recording sheet 13. The pressure plate 60 moves downward from this state in the drawing, and the recording sheet 13 is pressed by a predetermined pressure from the upper surface aperture 200. When the sheet feeding roller 48 is rotated counterclockwise, only one recording sheet 13 abutting on the sheet feeding roller 48 is moved in the left direction in the drawing and separated by the pawls. Then, the recording sheet 13 is fed from the feeding port 30.

Figure 22:
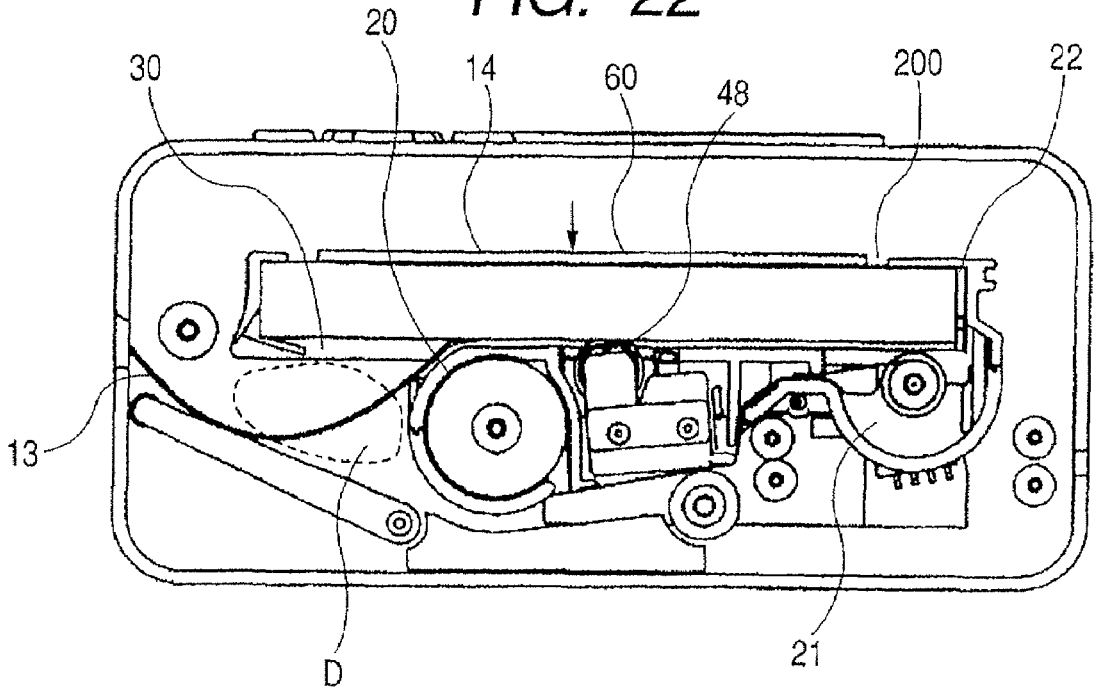
FIG. 22 is an explanatory view of the operation of the printer apparatus according to the embodiment of the present invention

FIG. 22 illustrates a state of how the thus-fed recording sheet 13 is sent by a predetermined quantity out of the cartridge 1.

As illustrated in FIG. 22, the recording sheet 13 gets warped along the supply-side containing portion (the first containing portion) 20 for the ink sheet 12, and fed out of the feeding port 30. The recording sheet 13 suited mainly to the use for printing the photo. If extremely bent, the printing surface might be damaged and corrugated. As illustrated in FIG. 22, however, the recording sheet 13 can be gently warped in a space area D on the left side of the supply-side containing portion 20 and under the feeding port 30. The sheet feeding roller 48 is capable of moving the recording sheet 13 substantially at the vicinity of the center of the recording sheet 13, and hence a sufficient warp-enabled length of the recording sheet 13 can be ensured. As a result, the reliability of the separation is improved, and the damage to the recording sheet 13 can be restrained down to the minimum without causing the extreme flexure of the recording sheet 13. This is derived from ensuring the space area D by disposing the ink sheet wind-up side containing portion (the second containing portion) 21 on the right side of the recording sheet containing portion 22 as viewed in FIG. 22.

The sheet feeding roller 48 is provided in the head unit 45, and therefore downsizing of the apparatus is attained. The upper surface aperture 200 for loading and pressurizing the recording sheets 13 is provided on the side opposite to the sheet feeding roller 48, and hence the efficient pressurization can be done.

Figure 23:
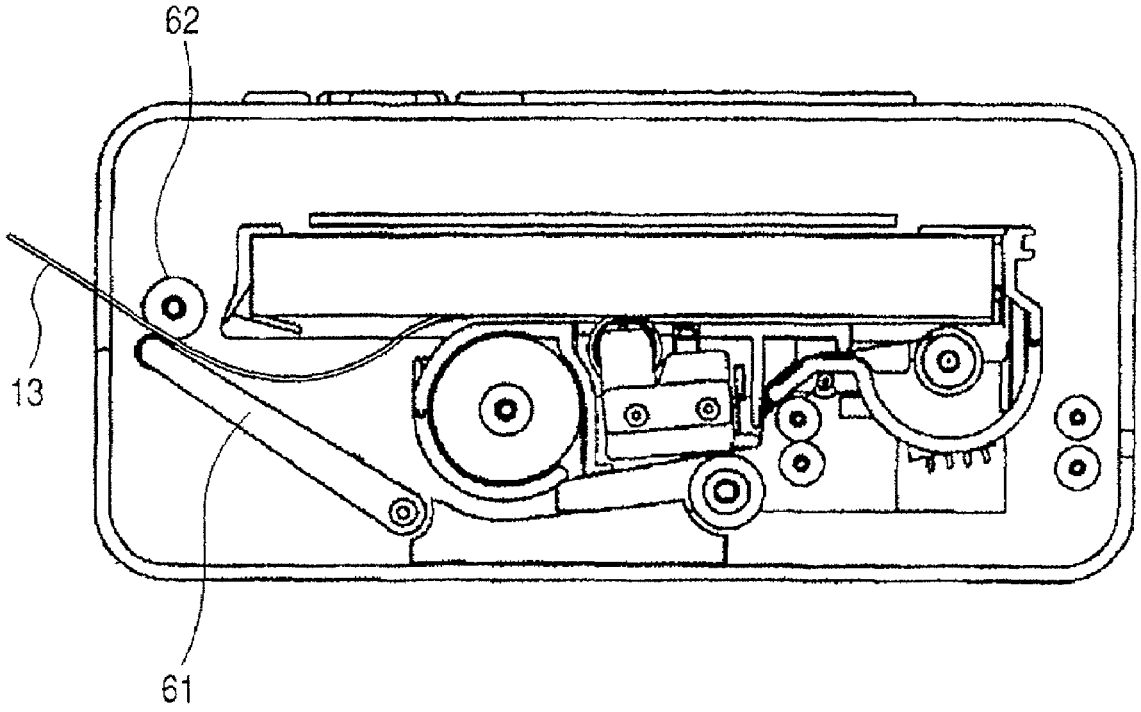
FIG. 23 is an explanatory view of the operation of the printer apparatus according to the embodiment of the present invention.
Figure 24:
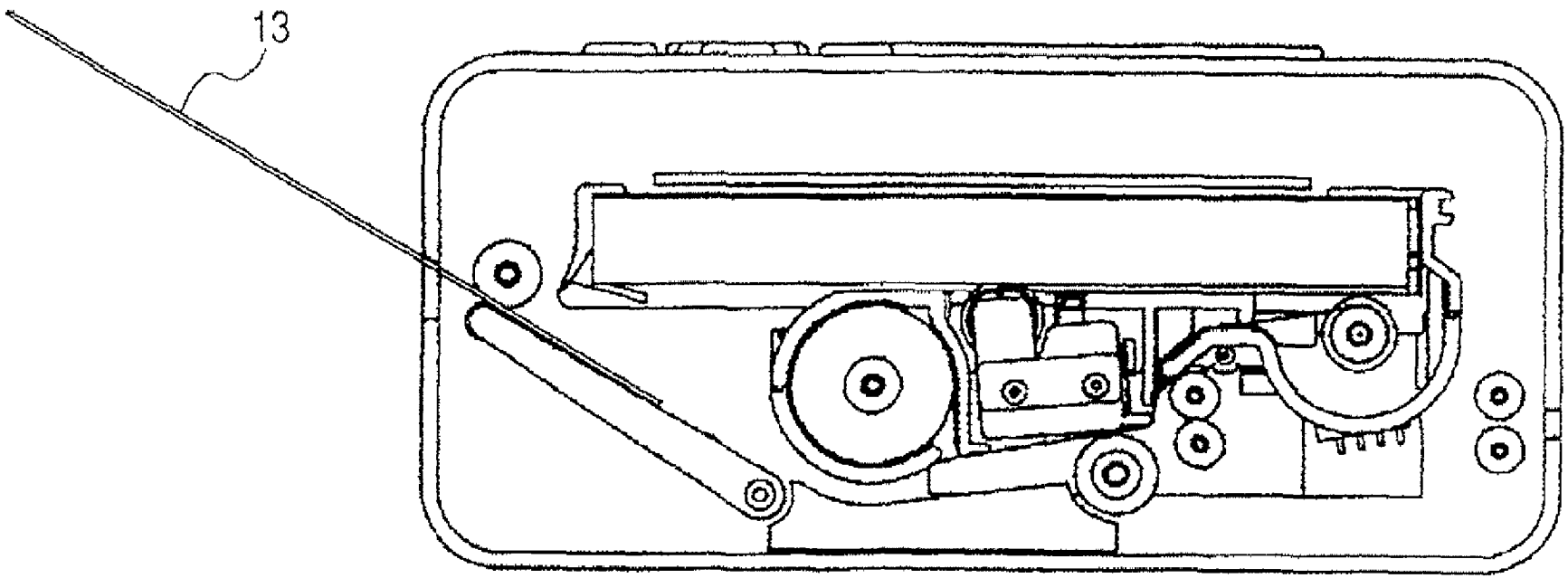
FIG. 24 is an explanatory view of the operation of the printer apparatus according to the embodiment of the present invention.
Figure 25:
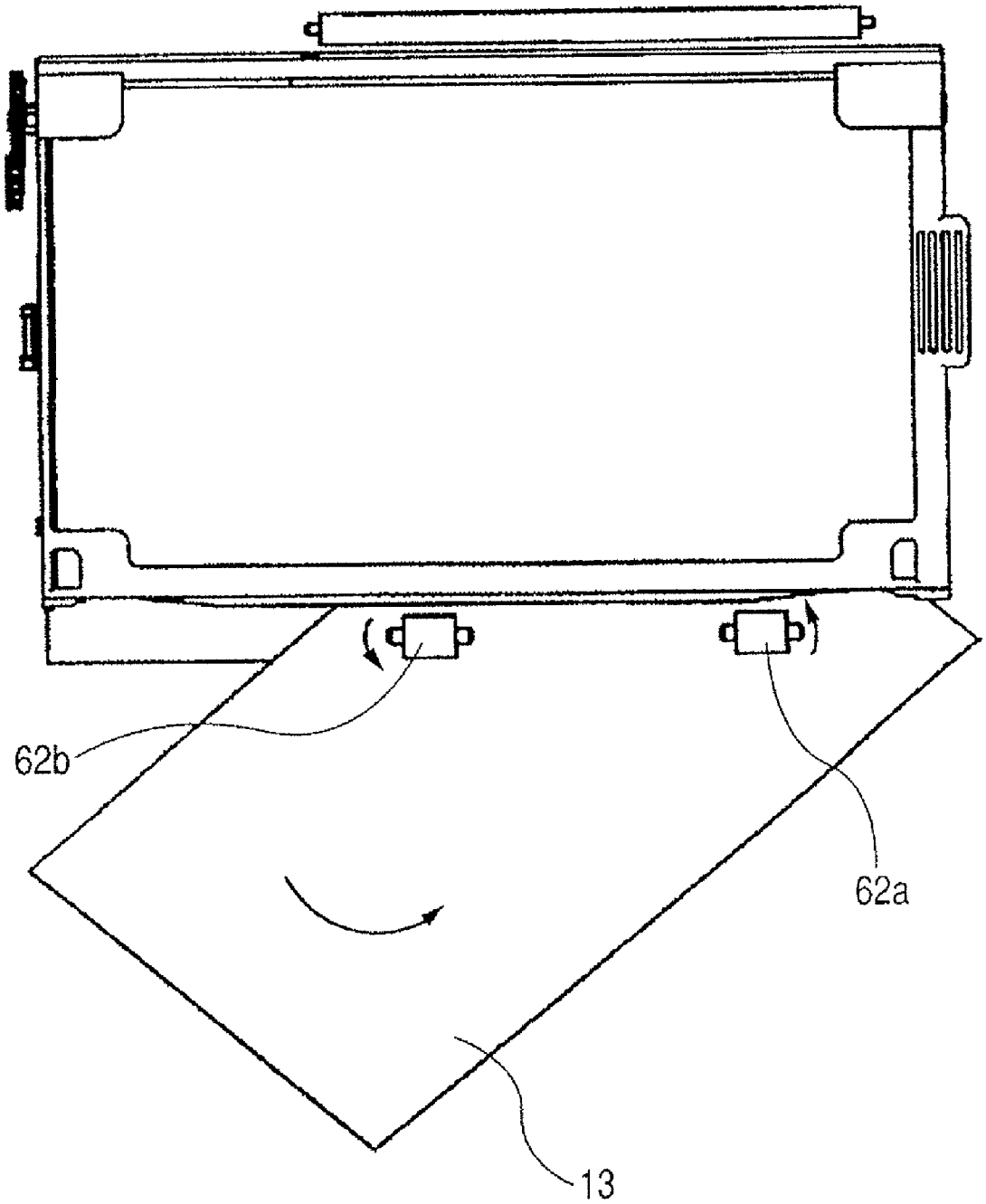
FIG. 25 is an explanatory view of the operation of the printer apparatus according to the embodiment of the present invention.
Figure 26:
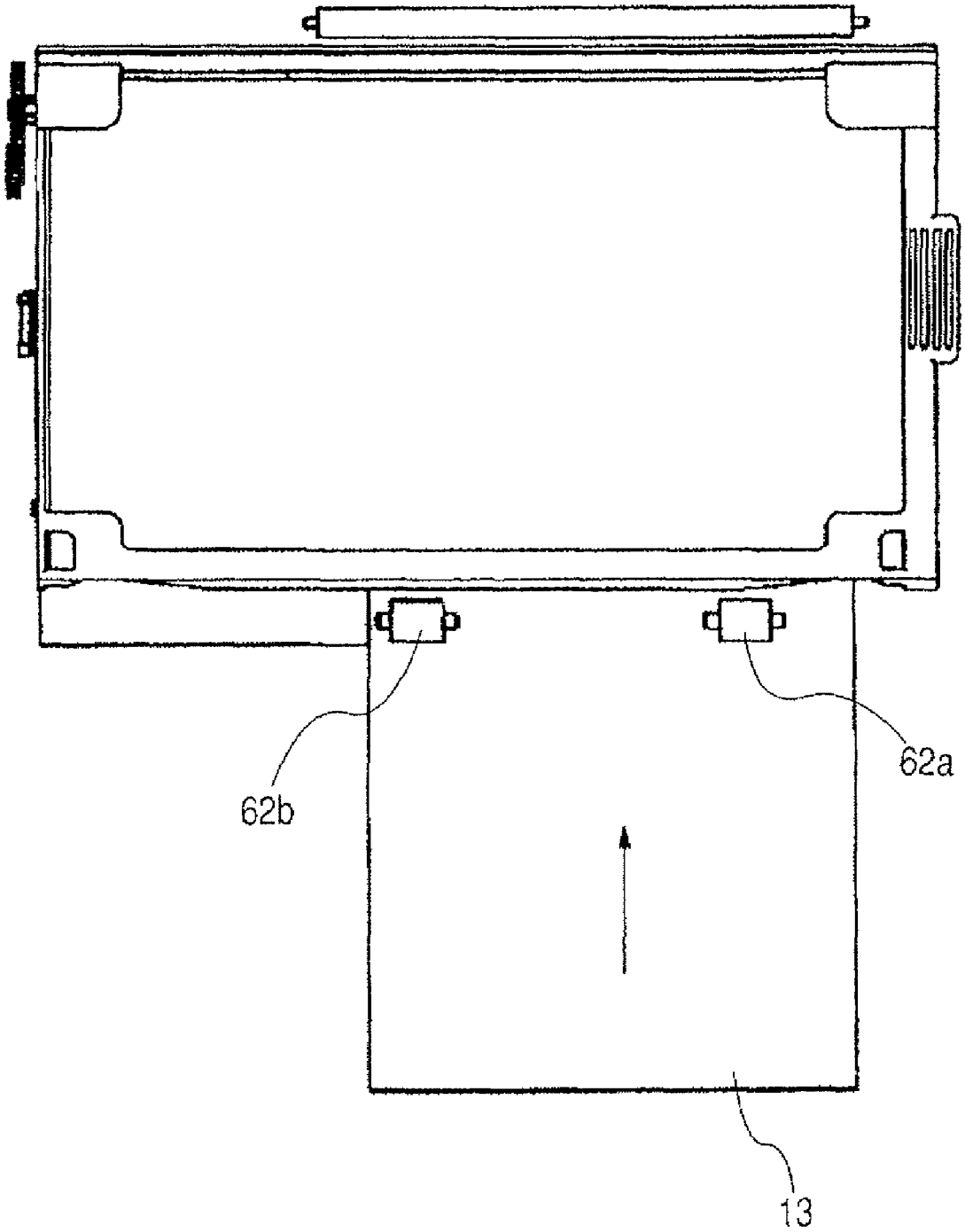
FIG. 26 is an explanatory view of the operation of the printer apparatus according to the embodiment of the present invention.

The recording sheet 13 is, after being fed by the predetermined quantity, as illustrated in FIG. 23, pressed against first rollers 62 by roller plates 61. The recording sheet 13 is further pulled out of the cartridge 1 as the first rollers 62 rotate. FIG. 24 illustrates a state in which the single recording sheet 13 is completely pulled out of the cartridge 1 and then fed by the predetermined quantity. The recording sheet 13 is turned from this state about the shaft extending in the direction vertical to the surface of the recording sheet 13. FIG. 25 illustrates a half-turned state of the recording sheet 13. The recording sheet 13 is turned by rotating two pieces of first rollers 62*a*, 62*b* in directions opposite to each other. The first roller 62*a* is rotated in the direction that drags the recording sheet 13 into the printer body 41, while the first roller 62*b* is rotated in the direction that sends the recording sheet 13 off the printer body 40. FIG. 26 illustrates a turn-completed state. The recording sheet 13 is fed into the printer body 40 by the first rollers 62*a*, 62*b*, thus shifting to the printing operation.

The roller plates 61 and the rollers 62*a*, 62*b*, which are employed for conveying the recording sheet 13, are preferably disposed in the space area D described referring to FIG. 22, thereby enabling the printer body 40 to be downsized. The recording sheet feeding port 30 is provided outside the ink sheet supply-side containing portion 20 on the upstream side of a conveyance route when printing, and hence the recording sheet 13 can be smoothly shifted to the conveyance for printing without performing futile conveyance.

Figure 27:
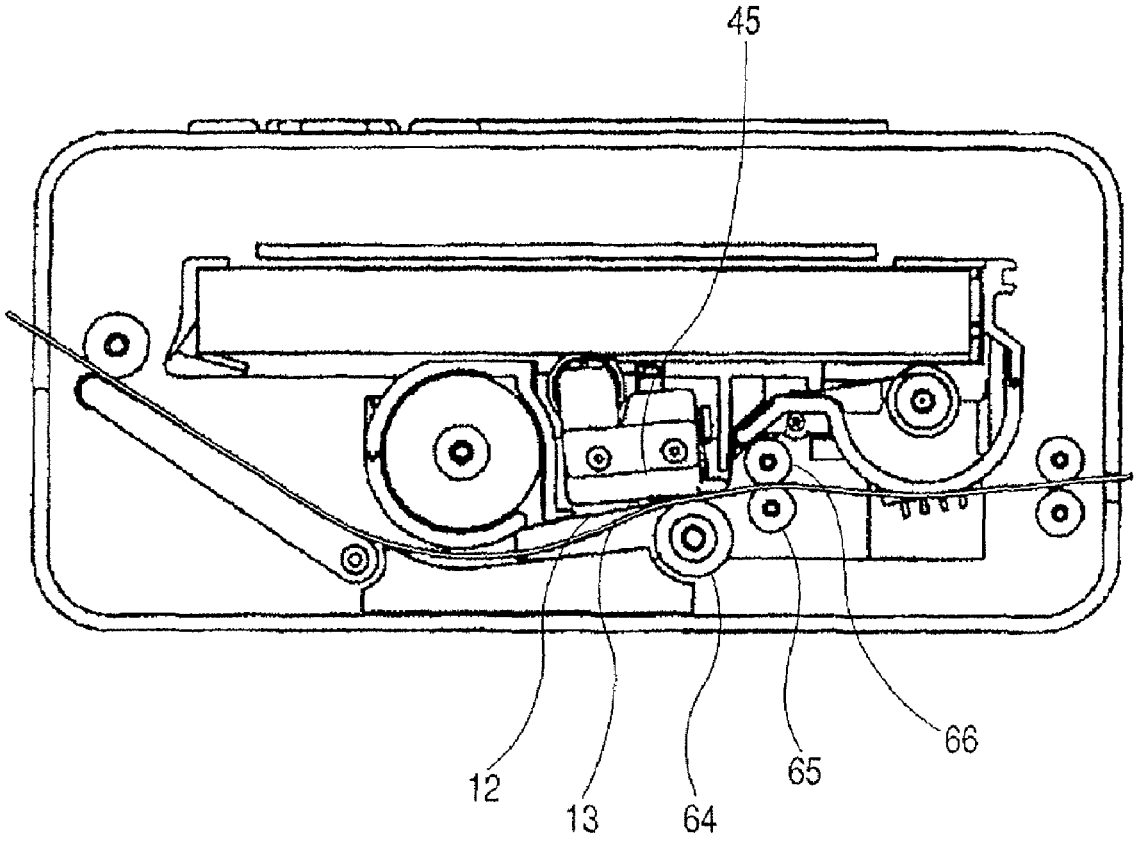
FIG. 27 is an explanatory view of the operation of the printer apparatus according to the embodiment of the present invention.

FIG. 27 illustrates a printing state of the recording sheet. The printing operation involves, at first, bringing the ink sheet 12 and the recording sheet 13 into a press-contact with each other by use of the thermal head unit 45 and a platen roller 64. An ink on the ink sheet 12 is thermally transferred onto the recording sheet 13 by the heat emitted from the thermal head unit 45. Then, the recording sheet 13 is conveyed by a pair of rollers, i.e., a capstan roller 65 and a pinch roller 66, provided downstream in the printing direction, thus conducting the printing. Upon an end of the first color print, the press-contact by the thermal head unit 45 is canceled. The recording sheet 13 is moved back to a print start position by rotating the capstan roller 65 and the pinch roller 66 in the directions opposite to those when performing the printing operation. Then, the recording sheet 13 undergoes the second and subsequent color printing by the same operation as of the first color. Thus, the full-color printing is performed in a way that superposes the three colors, yellow, magenta and cyan.

When the printing is completed, the recording sheet 13 is discharged outside to the right hand of the printer body 40. When a user performs the printing manipulation, the operations described above are repeatedly executed, and the printing can be thus done till the recording sheets 13 and the ink sheets 12 contained in the cartridge 1 are consumed up. The recording sheets 13 and the ink sheets 12, which are the same in their sheet counts, are contained, and therefore it does not happen that the recording sheets 13 or the ink sheets 12 are consumed up earlier. The printer according to the present embodiment has a contrivance that the printing operation is not conducted when detecting non-existence of the recording sheets 13.

Figure 28B:
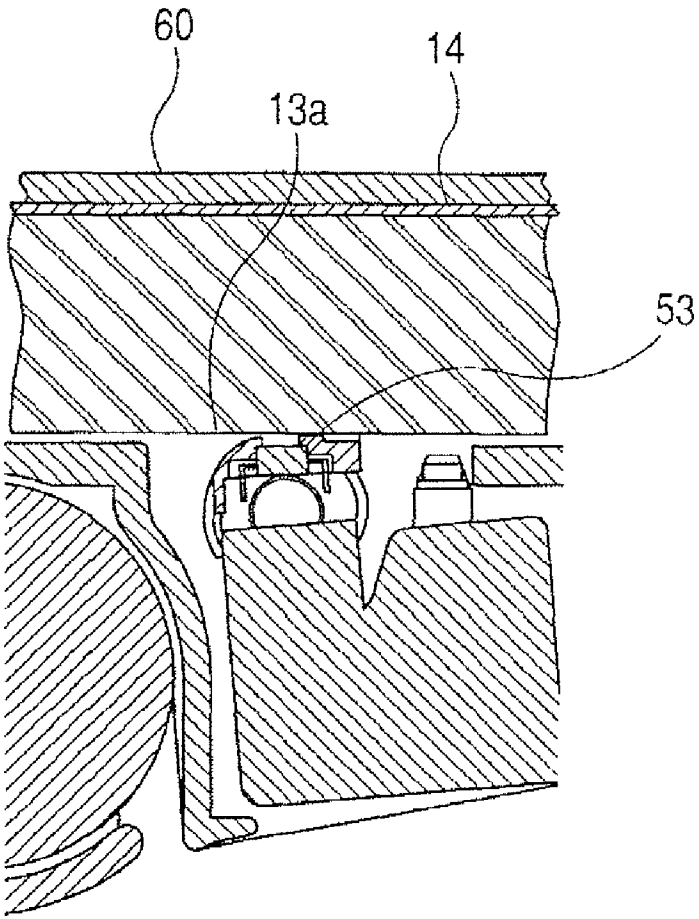
FIGS. 28A and 28B are explanatory views of a method of detecting existence or non-existence of the recording sheets in the cartridge.
Figure 28A:
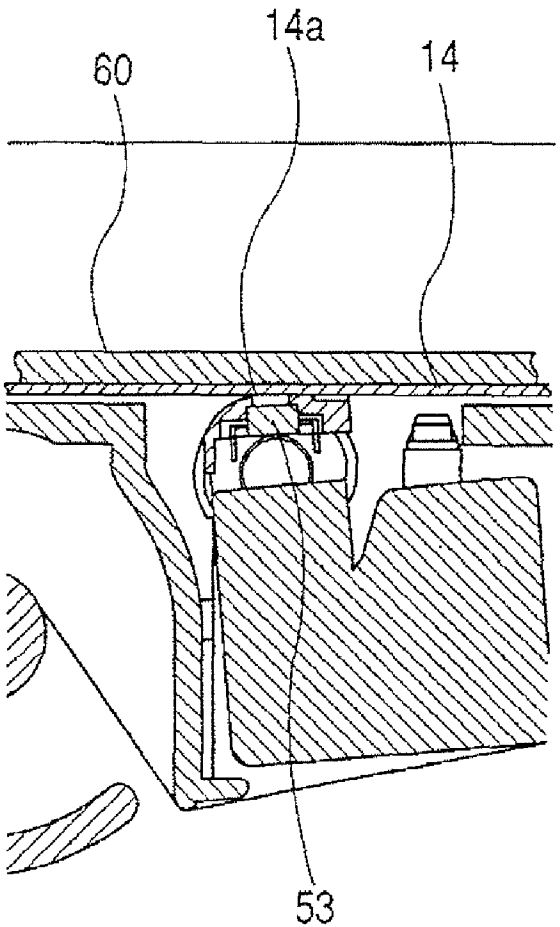
Figure 29:
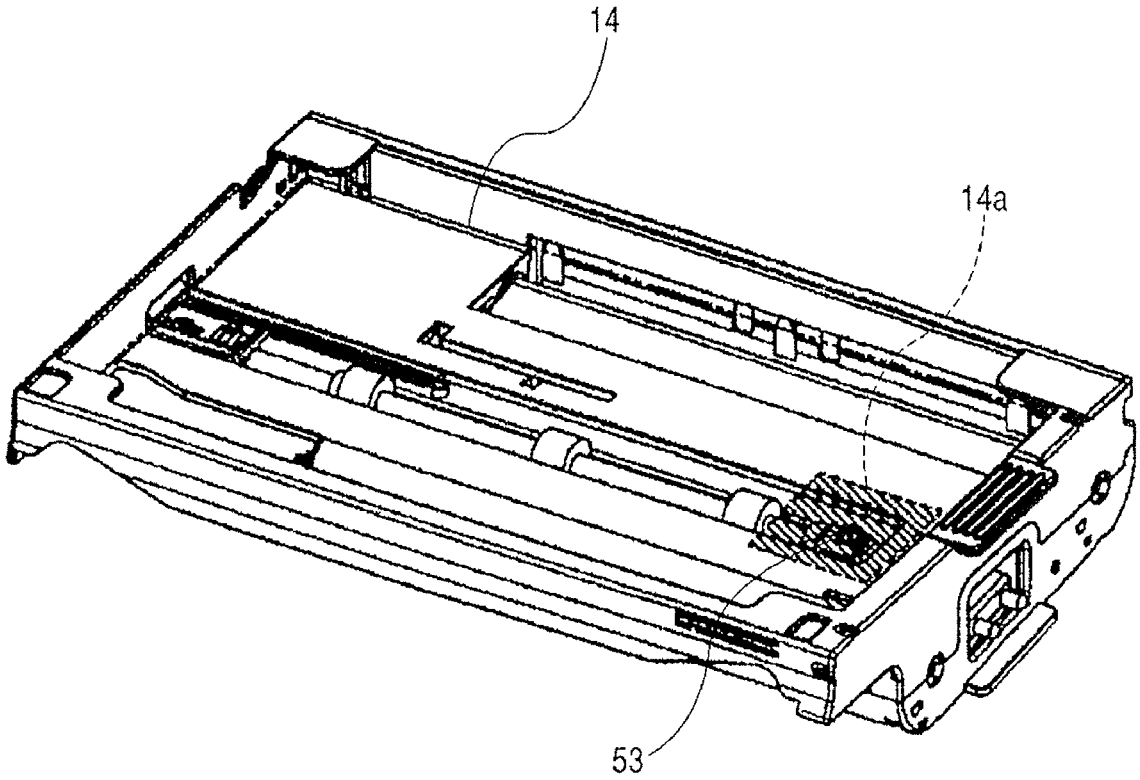
FIG. 29 is an explanatory view of the method of detecting the existence or non-existence of the recording sheets in the cartridge.

A method of detecting existence or non-existence of the recording sheets 13 will be described with reference to FIGS. 28A, 28B and 29. FIG. 28A illustrates a state in which a sufficient amount of recording sheet 13 exist in the cartridge 1. As illustrated in FIG. 28B, the photo reflector 53 is installed in the direction substantially facing the recording sheet 13. When the printing manipulation is conducted, the pressure plate 60 is pressed against the recording sheet 13, whereby the recording sheet 13 is pushed toward the photo reflector 53. Infrared light projected from the photo reflector 53 is reflected by an undersurface 13*a* of the recording sheet 13, and the reflected light is detected. The recording sheet 13, which is generally white, therefore has a comparatively high reflectance and is easy to be detected. The detecting operation is performed only when the pressure plate 60 is situated in a pressing position, and hence the detection with high reliability can be carried out.

FIG. 28A illustrates a state in which the printing manipulation is conducted in such a condition that only the protection sheet 14 is left while none of the recording sheets 13 exist in the cartridge 1, and it is detected whether the recording sheet 13 exists or not in a way that places the pressure plate 60 in the pressing position. As illustrated in FIG. 29, an ink, e.g., a black-printed area 14*a*, which reduces the reflectance of the infrared light, is applied on a portion, facing the photo reflector 53, of the protection sheet 14. The photo reflector 53 is incapable of detecting the reflected light, thereby determining non-existence of the recording sheets 13. The print exhibiting the low reflectance is adopted in the present embodiment, however, the same purpose can be attained because of being similarly incapable of detecting the reflected light even when forming, in place of the print, a hole of the same size as the printed range.

Figure 30:
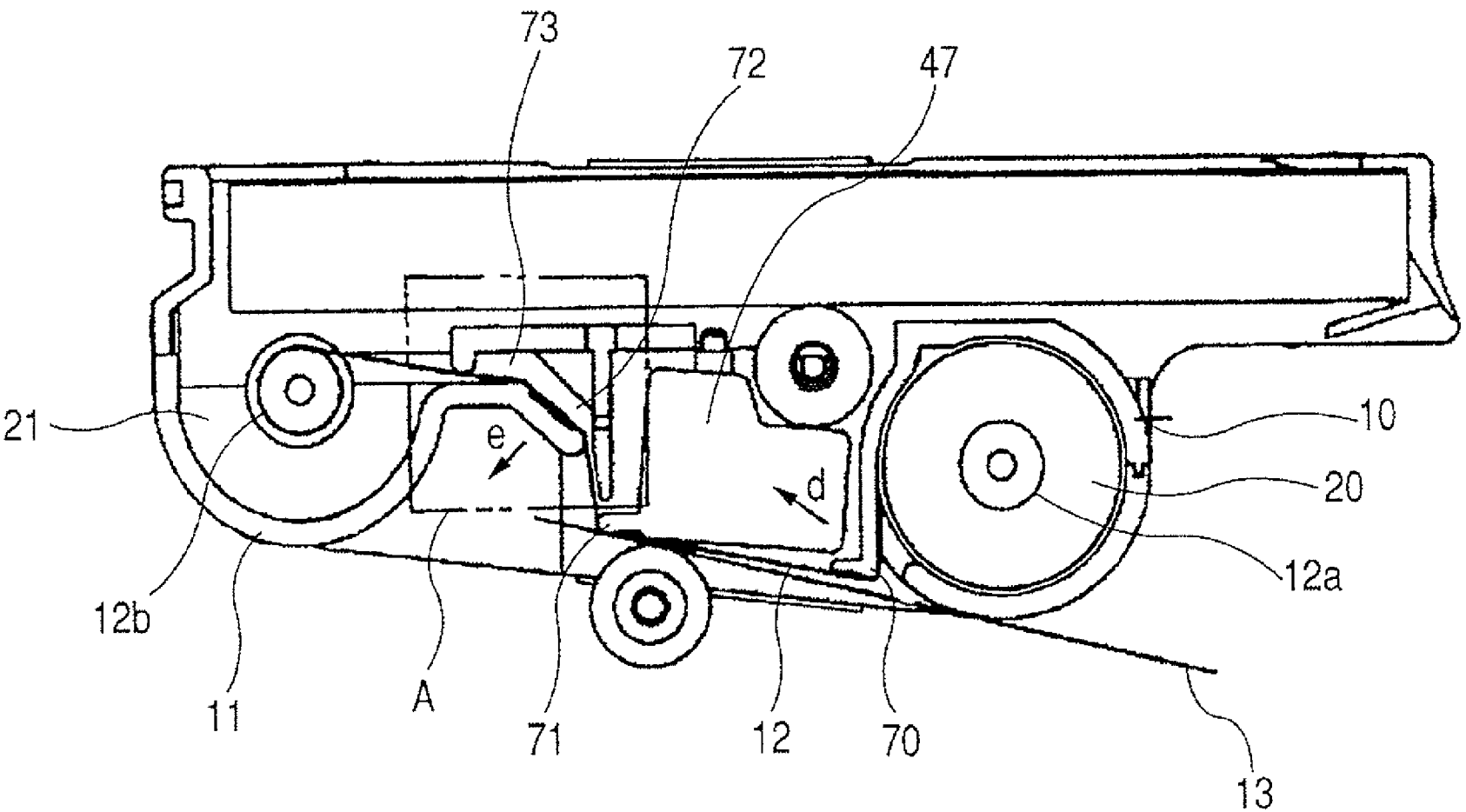
FIG. 30 is an explanatory view of how running of the ink sheet is stabilized when printing.
Figure 31:
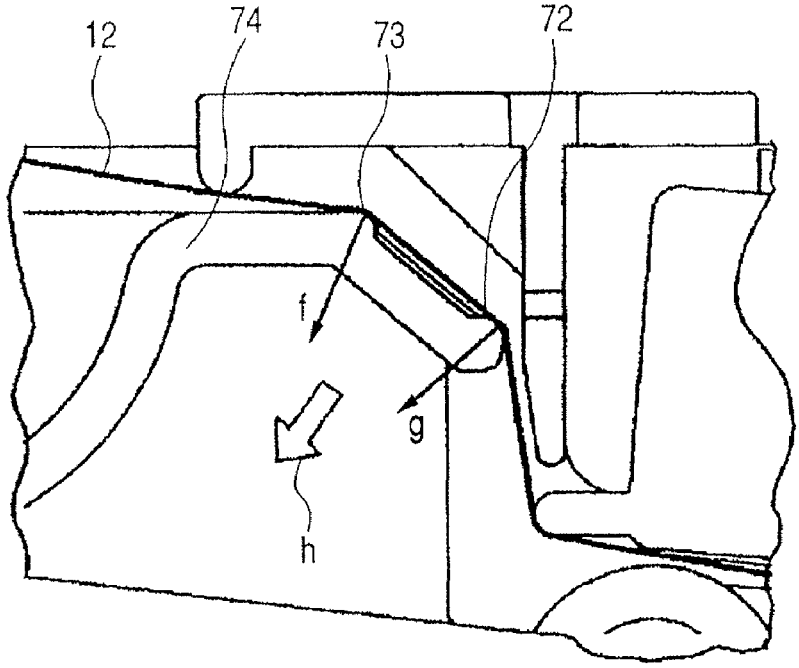
FIG. 31 is an explanatory view of how the running of the ink sheet is stabilized when printing.

Running of the ink sheet 12 when printing will be described. FIG. 30 is a view of a running route for the ink sheet 12 when printing as viewed from the side opposite to the cartridge insertion port of the printer body 40. The ink sheet 12 wound on the first bobbin 12*a* is, to begin with, turned by a first guide 70 toward the thermal head 47. The ink sheet 12 is, after being printed by the thermal head 47, peeled off the recording sheet 13 by a peeling plate 71. Thereafter, the ink sheet 12 is further turned by a second guide 72 and a third guide 73 of the lower case 11 and wound on the second bobbin 12*b*. During the printing, the ink sheet 12 needs giving a predetermined tension, and hence a predetermined torque is applied by a friction spring to the first bobbin 12*a*. The tension is applied also when peeled off the recording sheet 13 by the peeling plate 71. Hence, it follows that the load is applied in an arrowhead direction d to the upper case 10 and applied in an arrowhead direction e to the lower case 11. The respective loads are applied as moments about the first bobbin 12*a* and the second bobbin 12*b*, and it follows that torsional loads are applied to the upper case 10 and the lower case 11. The upper case 10 and the lower case 11 are the plastic products formed by the injection molding. The upper case 10 includes the feeding port 30 for feeding the recording sheet 13, the sheet feeding roller 48 and the aperture 34 for the photo reflector 53. Therefore, rigidity of a periphery to the supply-side containing portion 20 is low enough to cause deformation. Resultantly, large loads are applied to the second guide 72 and the third guide 73 of the lower case 11 also in the periphery to the wind-up side containing portion 21 due to the tension and the wind-up torque. FIG. 31 illustrates a detailed view of a portion A in FIG. 30. As illustrated in FIG. FIG. 31, the loads indicated by arrowheads g and f are applied to the second guide 72 and the third guide 73. The peripheral portions to the second guide 72 and the third guide 73 are caused to move so as to bend in an arrowhead direction h from the periphery to a bending portion 74 of the lower case 11.

If the upper case 10 and the lower case 11 are deformed, the running route for the ink sheet 12 might be distorted, with the result that the stable running can not be done. If disabled to run stably, meandering occurs when wound on the second bobbin 12*b*, or alternatively it follows that the corrugations appear. If the corrugations spread up onto the printing route, this leads to a critical problem to the printer such as the corrugations appearing on the print surface. It is therefore of much importance to scheme to stabilize the running route for the ink ribbon 12.

In the cartridge 1 according to the present embodiment, the first positioning hole 35 is formed in the edge surface of the supply-side containing portion 20 for the ink sheet, and the second positioning hole 36 is provided in the vicinity of the edge surface of the wind-up side containing portion 21 (FIG. 1). When the cartridge 1 is loaded into the printer body 40, the first positioning holes 35, 36 are fitted on the first positioning shaft 56 and the second positioning shaft 57, respectively (FIGS. 12 through 14). Therefore, the running route for the ink sheet 12 can be stabilized without being deformed by the torsional load. The shaft 80 provided on the upper case 10 and the hole 81 (FIGS. 4A and 4B) formed in the lower case 11 are joined together by the thermal welding. A degree of integrality of the upper case 10 with the peripheral portions of the second guide 72 and the third guide 73 of the lower case 11 rises, whereby the rigidity can be further increased and the running route can be further stabilized.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2006-042535, filed Feb. 20, 2006, which is hereby incorporated by reference herein in its entirety.

What is claimed is:

1. A recording sheet/ink sheet integral type cartridge, comprising:

a recording sheet containing portion that contains recording sheets by stacking the sheets; and an ink sheet containing portion that contains ink sheets, said recording sheet containing portion including:

two separating pawls disposed to catch corners of a leading edge of the recording sheets in a feeding direction and separating the recording sheets; and a first aperture portion formed in one of two side surfaces of said recording sheet containing portion in a direction orthogonal to the recording sheet feeding direction, the recording sheets being urged through the first aperture portion, wherein one of said two separating pawls, which is closer to said first aperture portion, is larger than the other.

2. A recording sheet/ink sheet integral type cartridge according to claim 1, further comprising a feeding port, formed in a bottom surface of said recording sheet containing portion, via which the recording sheets within said recording sheet containing portion are fed, and wherein said two separating pawls are disposed at said feeding port.

3. A recording sheet/ink sheet integral type cartridge according to claim 2, wherein said ink sheet containing portion is constructed to include, at the bottom surface of said recording sheet containing portion, a first containing portion that contains ink sheets to be supplied and a second containing portion that winds up the ink sheets, and wherein said feeding port neighbors said first containing portion and is formed in an edge portion of said recording sheet containing portion.

4. A recording sheet/ink sheet integral type cartridge according to claim 3, wherein a second aperture portion via which the recording sheets are fed, is provided between said first containing portion and said second containing portion at the bottom surface of said recording sheet containing portion, and wherein said second aperture portion extends in a direction orthogonal to the recording sheet feeding direction and communicates with said first aperture portion.

5. A recording sheet/ink sheet integral type cartridge according to claim 1, wherein the separation pawl which is closer to the first aperture portion has a length orthogonal to the feeding direction of the sheet that is longer than the length of the other separation pawl.

6. A recording sheet/ink sheet integral type cartridge according to claim 1, wherein an urging member of a printer urges ends of the recording sheets in the recording sheet containing portion through the first aperture portion when the cartridge is mounted on the printer so that the recording sheets are located to a side of the recording sheet containing portion where the first aperture portion is not provided.

* * * * *